US007341499B2

(12) United States Patent
Wizenberg et al.

(10) Patent No.: US 7,341,499 B2
(45) Date of Patent: Mar. 11, 2008

(54) TOY GLIDER

(75) Inventors: Anatol Wizenberg, Kowloon (HK); Peter Dean, Pok Fu Lam (HK); Wai Bun Choi, Chai Wan (HK); Ming To Chan, Chai Wan (HK); Lai Hong Man, Ma On Shan (HK)

(73) Assignee: Worldmarks Limited (VG)

( * ) Notice: Subject to any disclaimer, the term of this patent is extended or adjusted under 35 U.S.C. 154(b) by 175 days.

(21) Appl. No.: 10/755,519

(22) Filed: Jan. 12, 2004

(65) Prior Publication Data

US 2005/0153620 A1 Jul. 14, 2005

(51) Int. Cl.
*A63H 33/02* (2006.01)

(52) U.S. Cl. ..... 446/29

(58) Field of Classification Search ..... 446/29, 446/98, 301, 331, 369, 397, 408, 101, 337; 472/96–99

See application file for complete search history.

(56) References Cited

U.S. PATENT DOCUMENTS

| | | | | | |
|---|---|---|---|---|---|
| 1,726,626 | A | * | 9/1929 | Miller | 280/826 |
| 2,351,510 | A | * | 6/1944 | Harless | 446/29 |
| D155,748 | S | * | 10/1949 | Szantay | D21/421 |
| 2,519,489 | A | * | 8/1950 | McDevitt | 446/29 |
| 2,571,266 | A | * | 10/1951 | Levay | 446/29 |
| 2,648,160 | A | * | 8/1953 | Van Voorhis | 446/29 |
| 2,730,365 | A | * | 1/1956 | Godoy | 446/29 |
| 2,940,755 | A | * | 6/1960 | Pouder | 446/29 |
| 3,199,867 | A | * | 8/1965 | Pembridge | 446/29 |
| 5,356,329 | A | * | 10/1994 | Thornell | 446/485 |
| 5,547,412 | A | * | 8/1996 | Wilcox | 446/73 |
| 6,524,156 | B1 | * | 2/2003 | Horchler et al. | 446/29 |

* cited by examiner

*Primary Examiner*—Kien T. Nguyen
(74) *Attorney, Agent, or Firm*—DLA Piper US LLP

(57) ABSTRACT

A toy glider including a shaft, a roller attached to a first end of the shaft, and a housing attached to a second opposing end of the shaft. The roller, a front end portion of the housing, and other portions of the toy glider are interchangeable to create a variety of different designs.

17 Claims, 32 Drawing Sheets

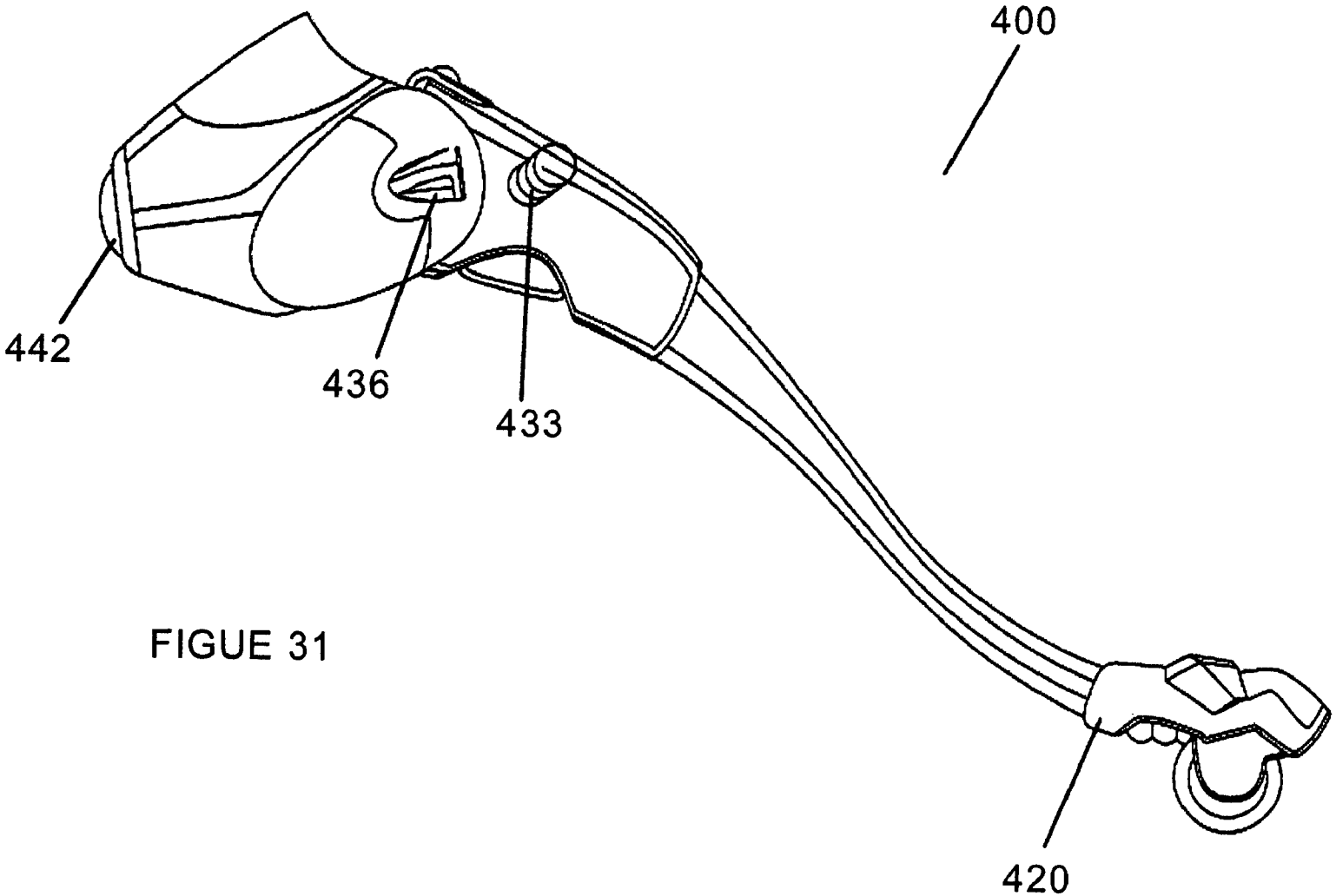
FIGUE 31

TOY GLIDER

FIELD OF THE INVENTION

This present invention relates to toys, and in particular, to a toy glider.

BACKGROUND OF THE INVENTION

Stick horses have been popular toys with children for many years. Stick horses essentially comprises a wooden stick with a plush horse head attached to one end. The idea behind the stick horse is that children place the wooden stick portion between their legs and 'pretend' to ride the horse.

Although the stick horse was a popular toy for many years, it is also a very outdated toy. Due to the fact that horses have been replaced as a means of transportation in modem society with automobiles, motorcycles, bus and planes, to name a few, the viability of a toy horse is diminished. With the modernization of transportation, children are more likely to gravitate to modem vehicles as playthings.

Although there exist toy cars and the like, there are presently no commercially available simple toys which allow children to 'pretend' to drive or pilot modem vehicles, such as cars, trucks, and airplanes. Thus, there is presently a need for toy which simulates this experience for children.

SUMMARY OF THE INVENTION

An exemplary embodiment of the present invention comprises a toy glider including a shaft, a roller attached to a first end of the shaft, and a housing attached to a second opposing end of the shaft.

An exemplary embodiment of the present invention also comprises a method for manufacturing a toy glider including the steps of providing a shaft, coupling at least one roller to a first end of the shaft, and coupling at least one housing to a second opposing end of the shaft.

BRIEF DESCRIPTION OF THE DRAWINGS

FIG. 31 is a left side view of the toy glider of FIG. 27.

DETAILED DESCRIPTION

Figure 1:
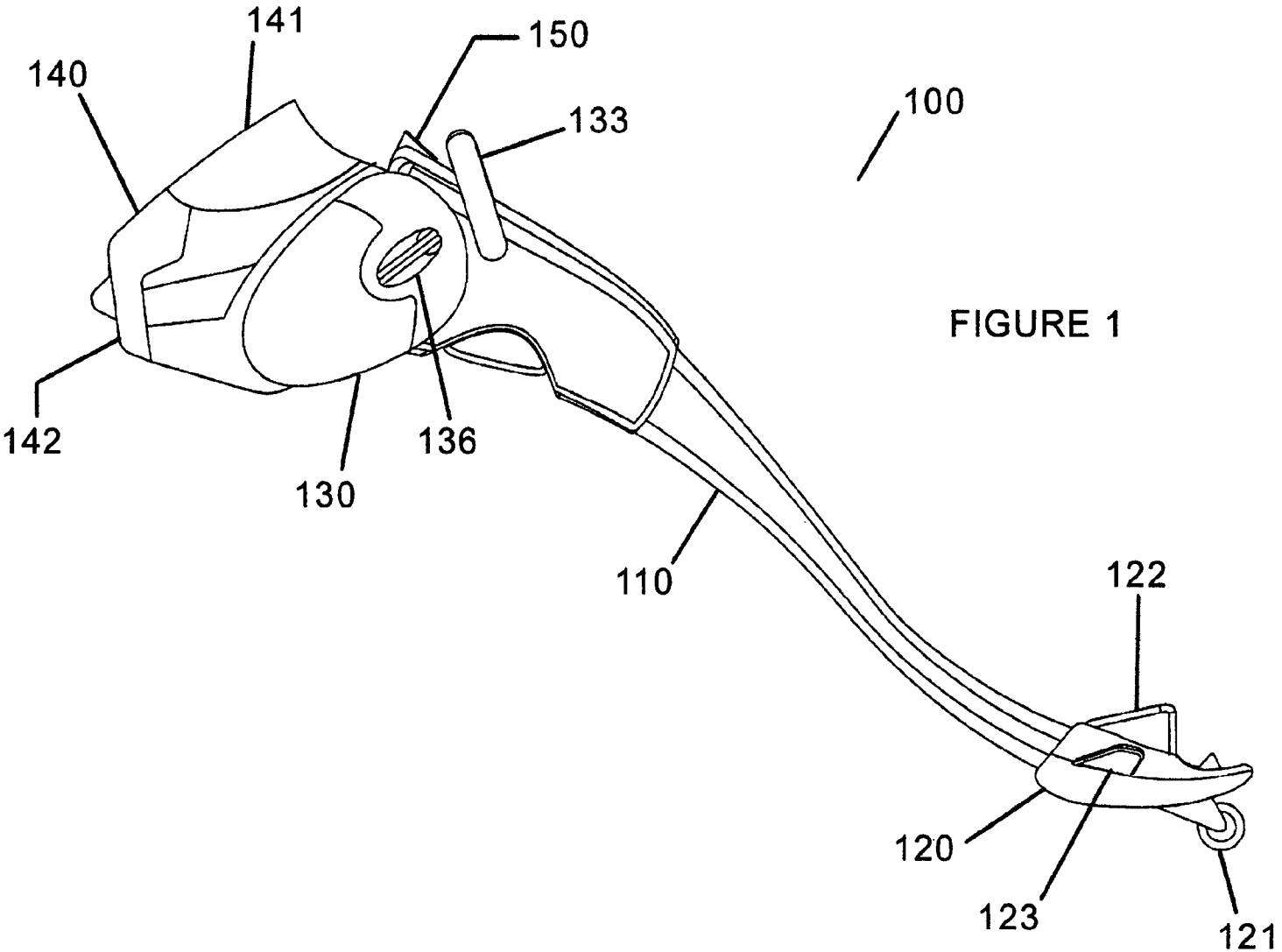
FIG. 1 is a left side view showing a toy glider according to a first exemplary embodiment of the present invention.
Figures 2, 3:
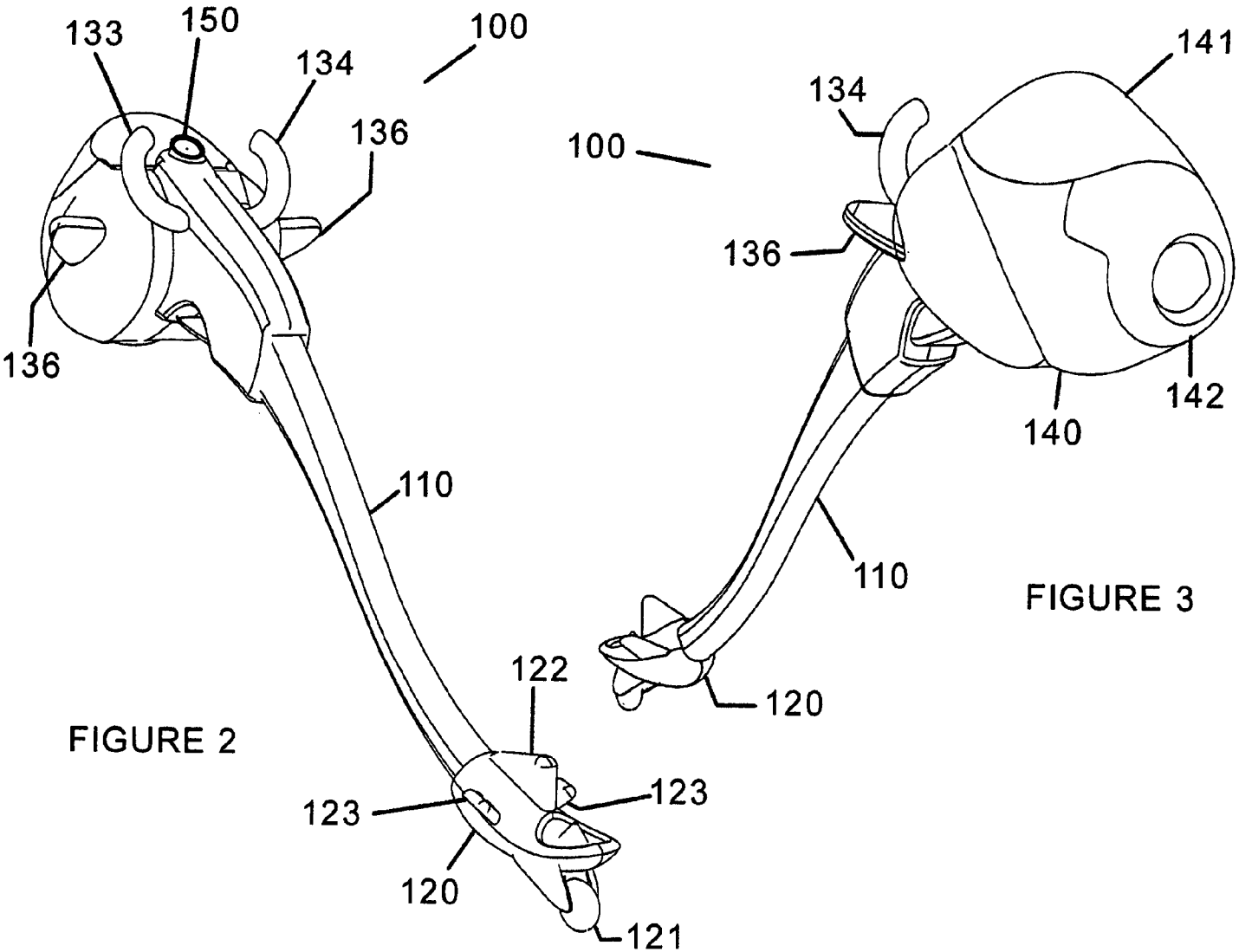
FIG. 2 is a back side isometric view showing the toy glider of FIG. 1.
FIG. 3 is a back side isometric view showing the toy glider of FIG. 1.

FIGS. 1-3 show a toy glider 100 according to a first exemplary embodiment of the present invention. FIG. 1 shows a left side view of the toy glider 100, and FIGS. 2 and 3 show isometric views. The toy glider 100 comprises a shaft 110, a roller 120, a housing 130, a front end 140 and a sound and/or light pad 150.

The shaft 110 may comprise a unitary member, or may comprises a two-piece 'snap-fit' construction, as is well known in the art. The roller 120 is coupled to a first end 111 of the shaft 110 and includes at least one wheel 121, which may be held in place by an axle (now shown) disposed in the roller body. The roller 120 may also include optional decorative members, such as decorative wings 122, 123 shown. As will be explained in detail below, the decorative wings 122, 123 may comprise a plurality of different designs, such as for example, the tail wings of a jet plane (or spaceship), the bumper and/or tail lights of an automobile, or other various designs.

The housing 130 preferably includes handles 133, 134 for grasping and holding the toy glider 100. As with the roller 120, the housing 130 may also include optional decorative members, such as decorative wings 136 shown. As will be explained in detail below, the decorative wings 136 may comprise a plurality of different designs, such as for example, the wings of a jet plane (or spaceship), the rear view mirrors of an automobile, or other various designs.

The front end 140 preferably includes a toy windscreen 141 and a decorative bumper 142. As will be explained in detail below, the decorative bumper 142 may comprise a plurality of different designs, such as for example, the front end of a jet plane, the front end of an automobile, or other various designs.

The sound and/or light pad 150 may be configured to emit sounds, light displays, or both. The sound and/or light pad 150 may also include buttons, switches or other members which serve to actuate the sound and/or light displays. For example, if the toy glider 100 is made to resemble a police car, the sound and/or light pad 150 may include a 'siren' sound and flashing red lights.

Figure 4:
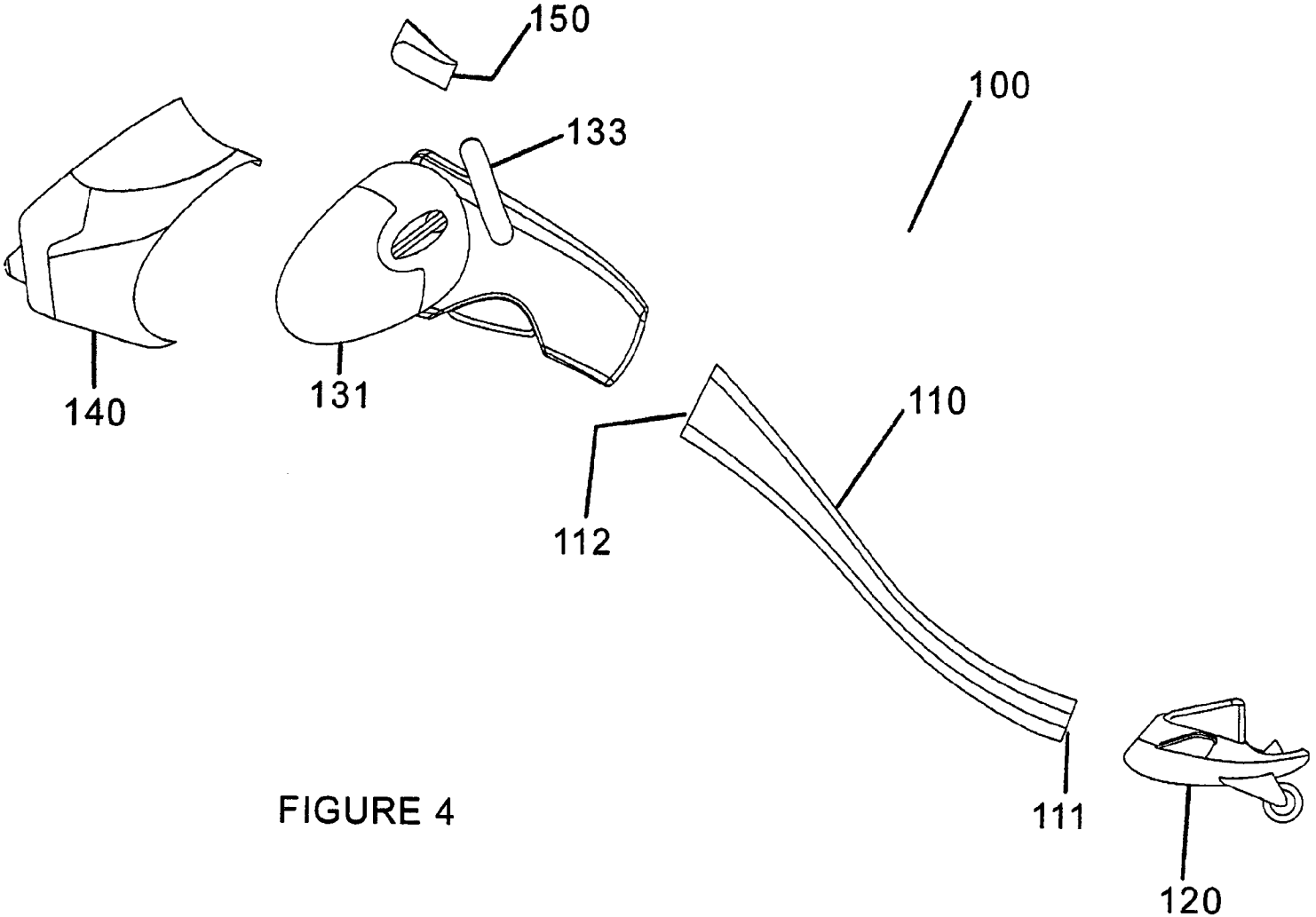
FIG. 4 is a left side exploded view showing the toy glider of FIG. 1.
Figure 5:
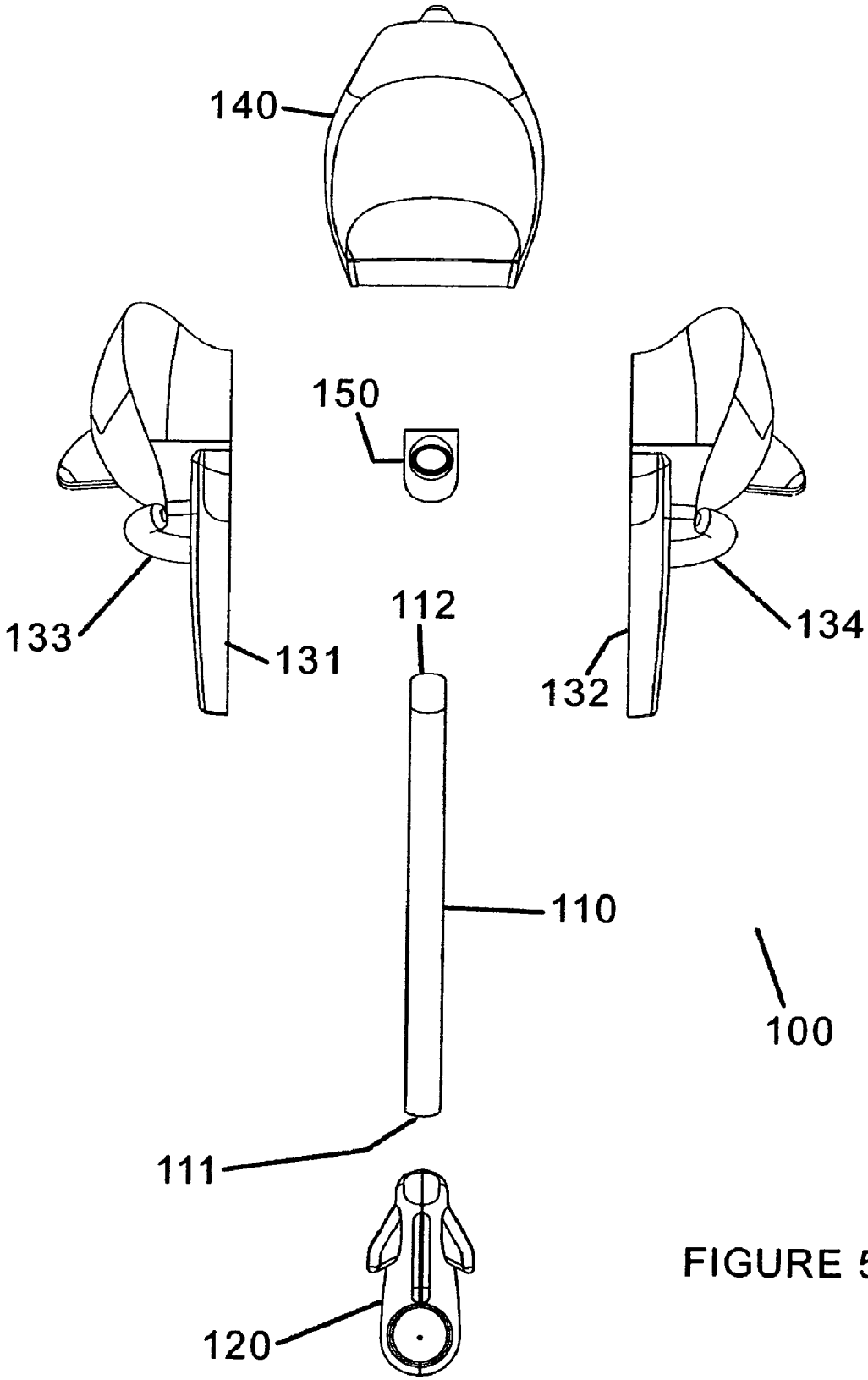
FIG. 5 is a top side exploded view showing the toy glider of FIG. 1.

As shown in FIGS. 4 and 5, the housing 130 may be formed of left half piece 131, and a right half piece 132 which are preferably coupled together at one end of the shaft 110, so as to secure a second end 112 of the shaft 110 therebetween. As also shown in FIGS. 4 and 5, the first end 111 of the shaft 110 may be disposed and secured within an opening in the roller 120.

Figure 6:
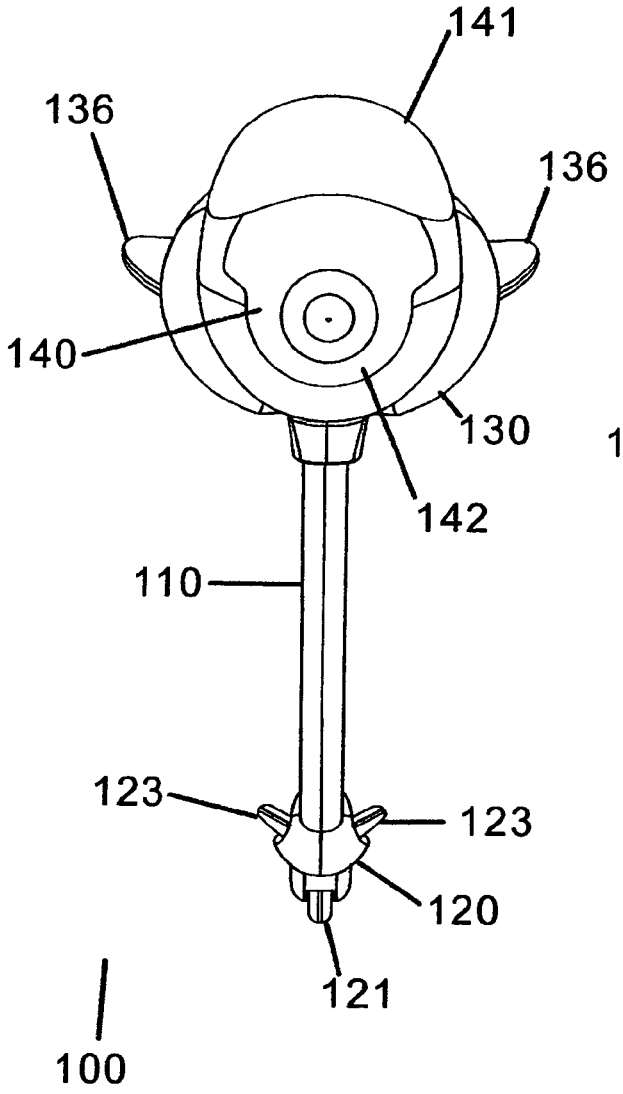
FIG. 6 is a front view showing the toy glider of FIG. 1.
Figure 7:
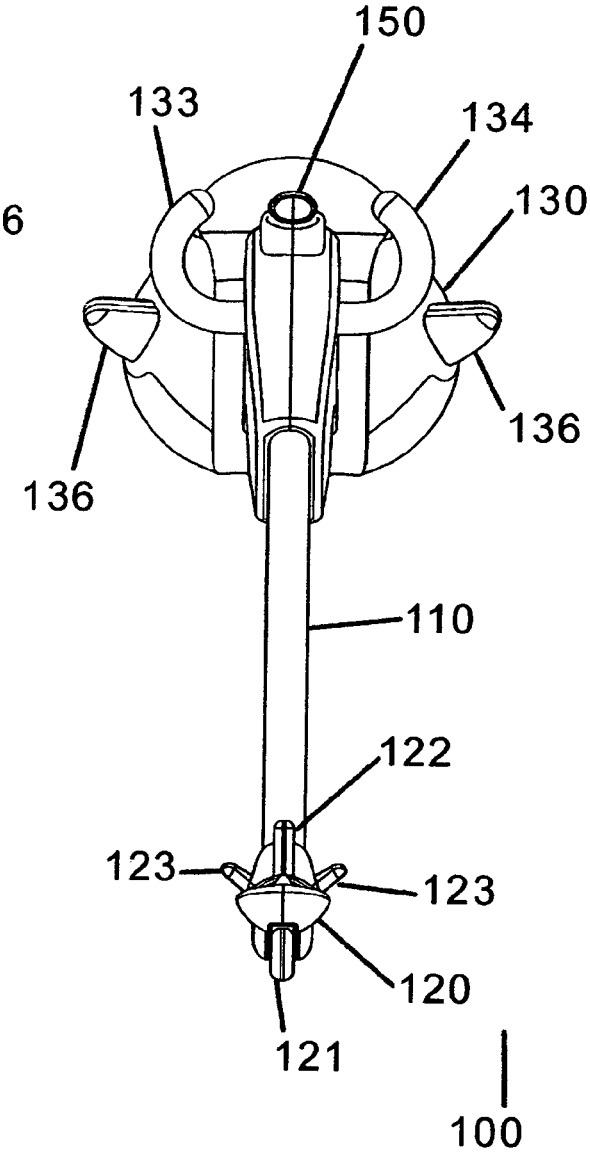
FIG. 7 is a rear view showing the toy glider of FIG. 1.
Figure 8:
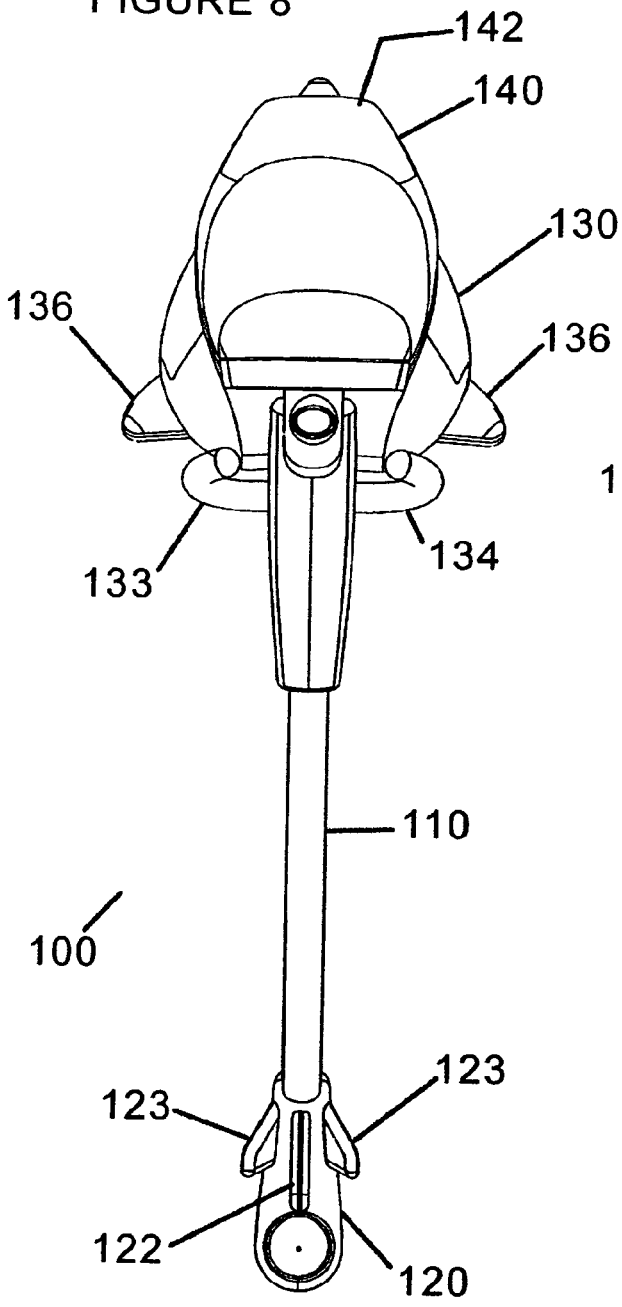
FIG. 8 is a top view showing the toy glider of FIG. 1.
Figure 9:
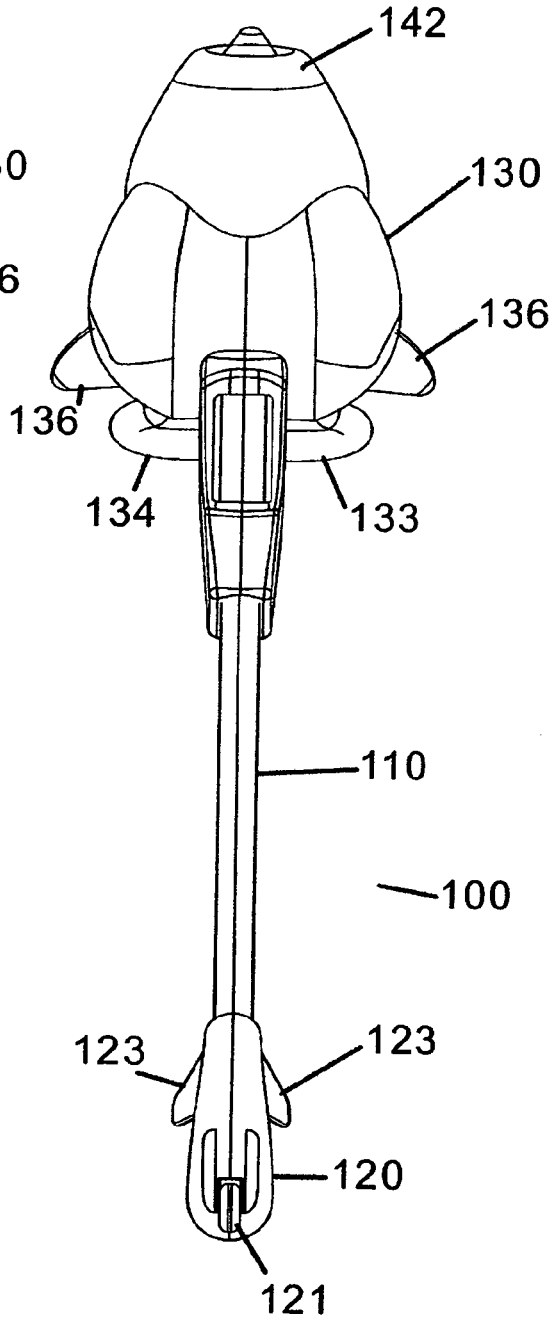
FIG. 9 is a bottom view showing the toy glider of FIG. 1.

FIGS. 6-9 show additional views of the toy glider 100. In particular, FIG. 6 shows a front view of the toy glider 100, and FIG. 7 shows a rear view. FIG. 8 shows a top view of the glider 100, and FIG. 9 shows a bottom view.

Figure 10:
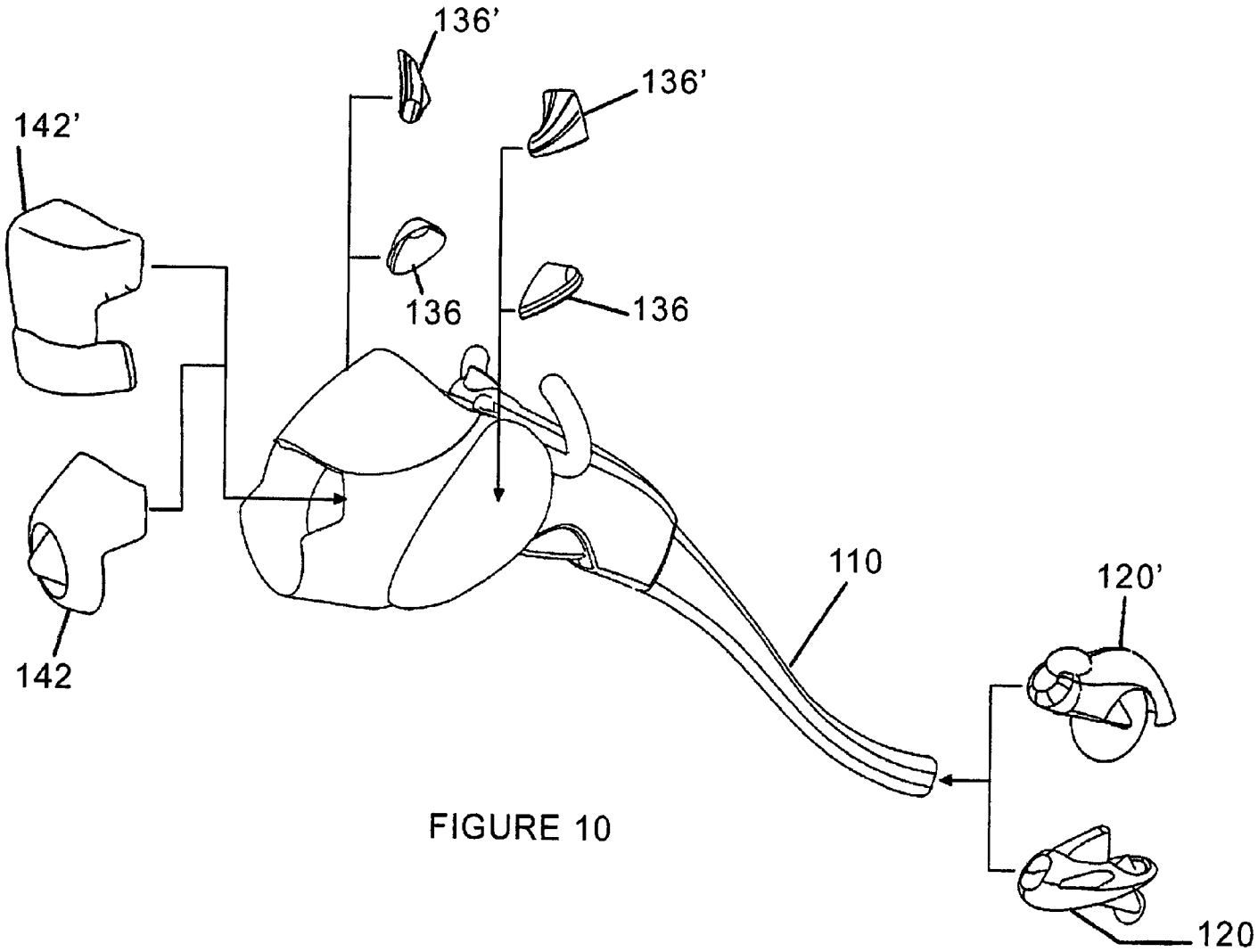
FIG. 10 is an exploded view of exemplary embodiments of the toy glider showing interchangeable parts.
Figure 11:
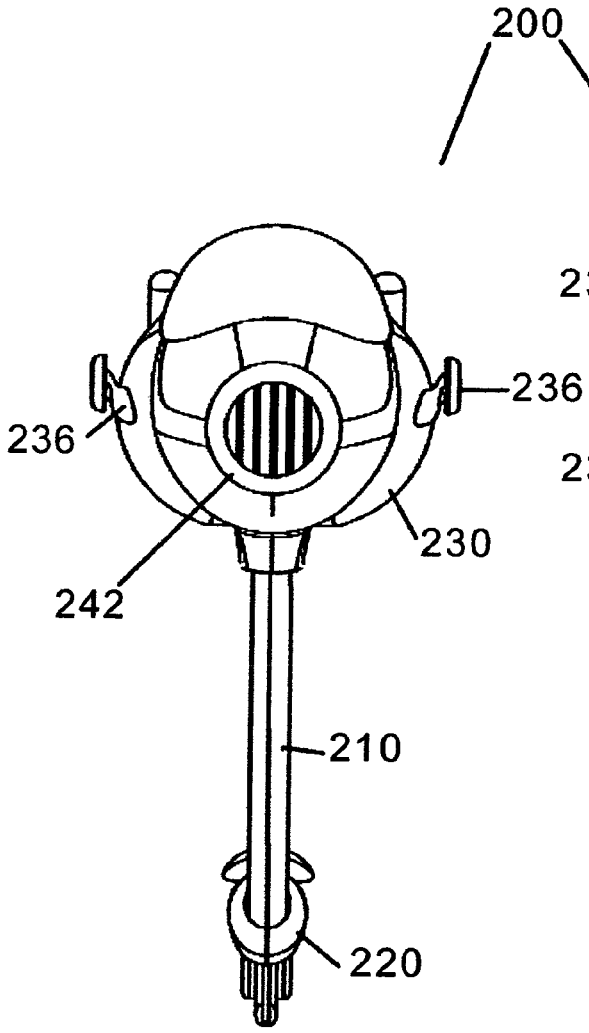
FIG. 11 is front view of a toy glider according to a second exemplary embodiment of the present invention.
Figure 12:
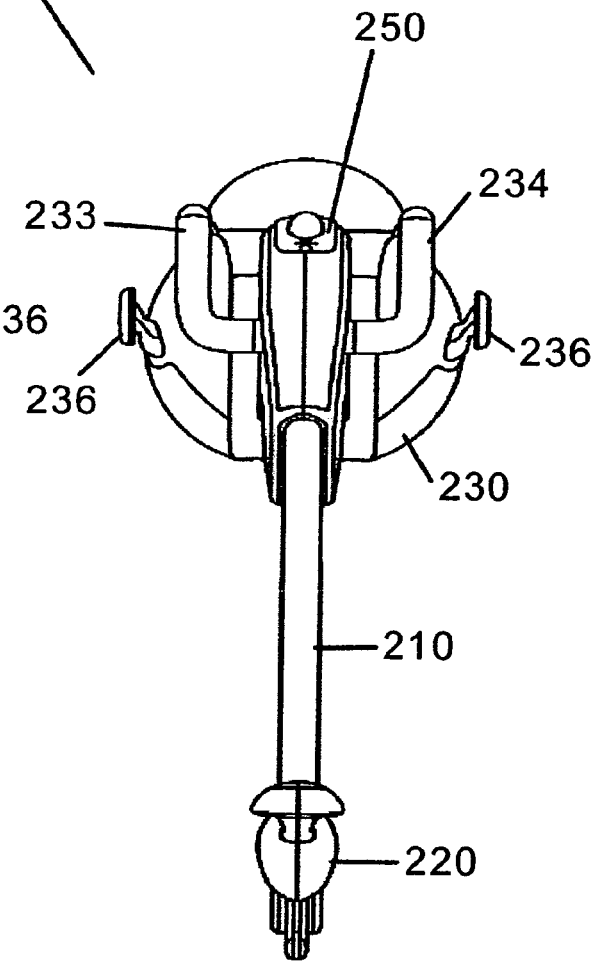
FIG. 12 is a rear view of a the toy glider of FIG. 11.
Figures 13, 14:
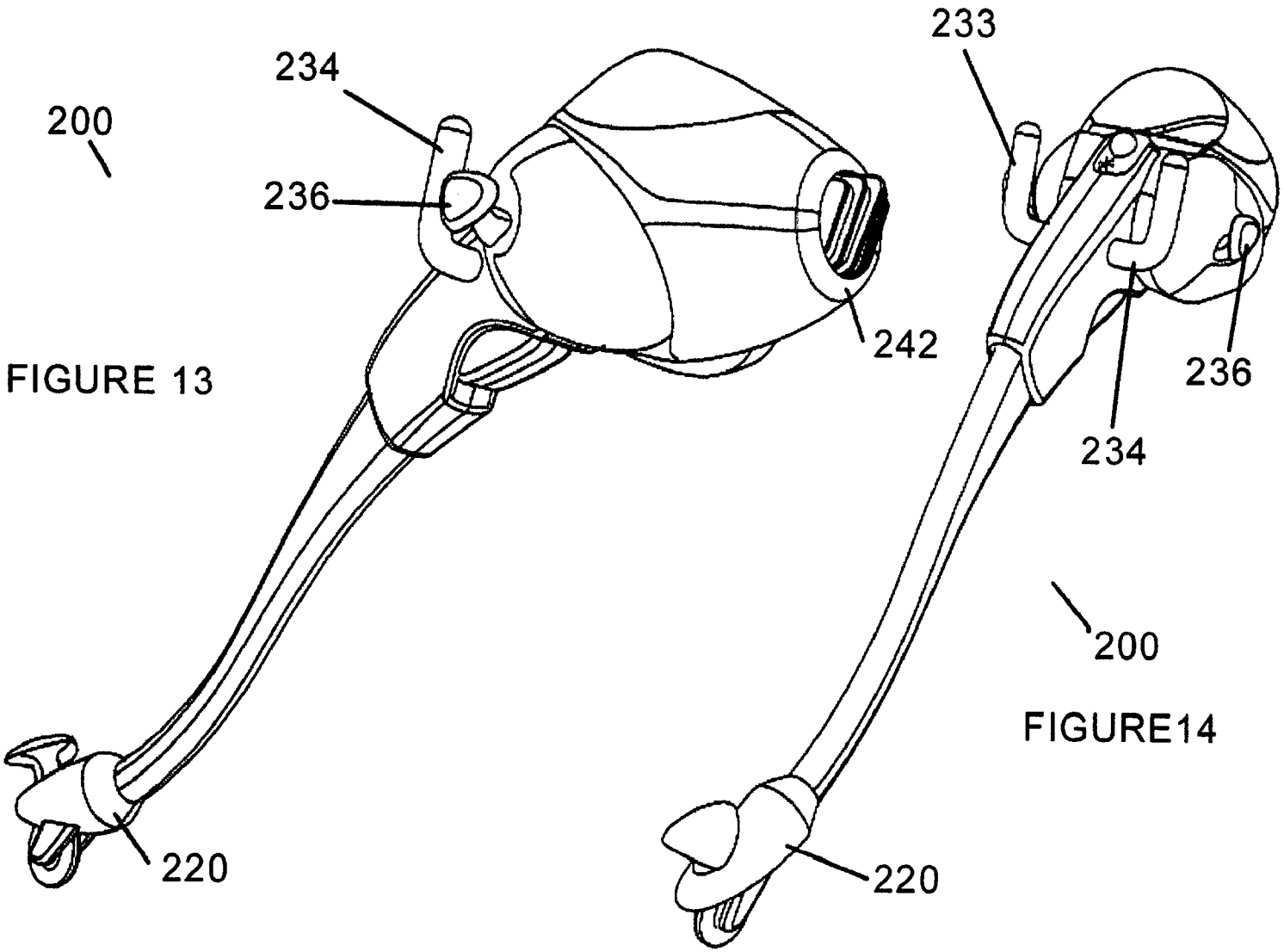
FIG. 13 is a front perspective view of the toy glider of FIG. 11.
FIG. 14 is a rear perspective view of the toy glider of FIG. 11.
Figure 15:
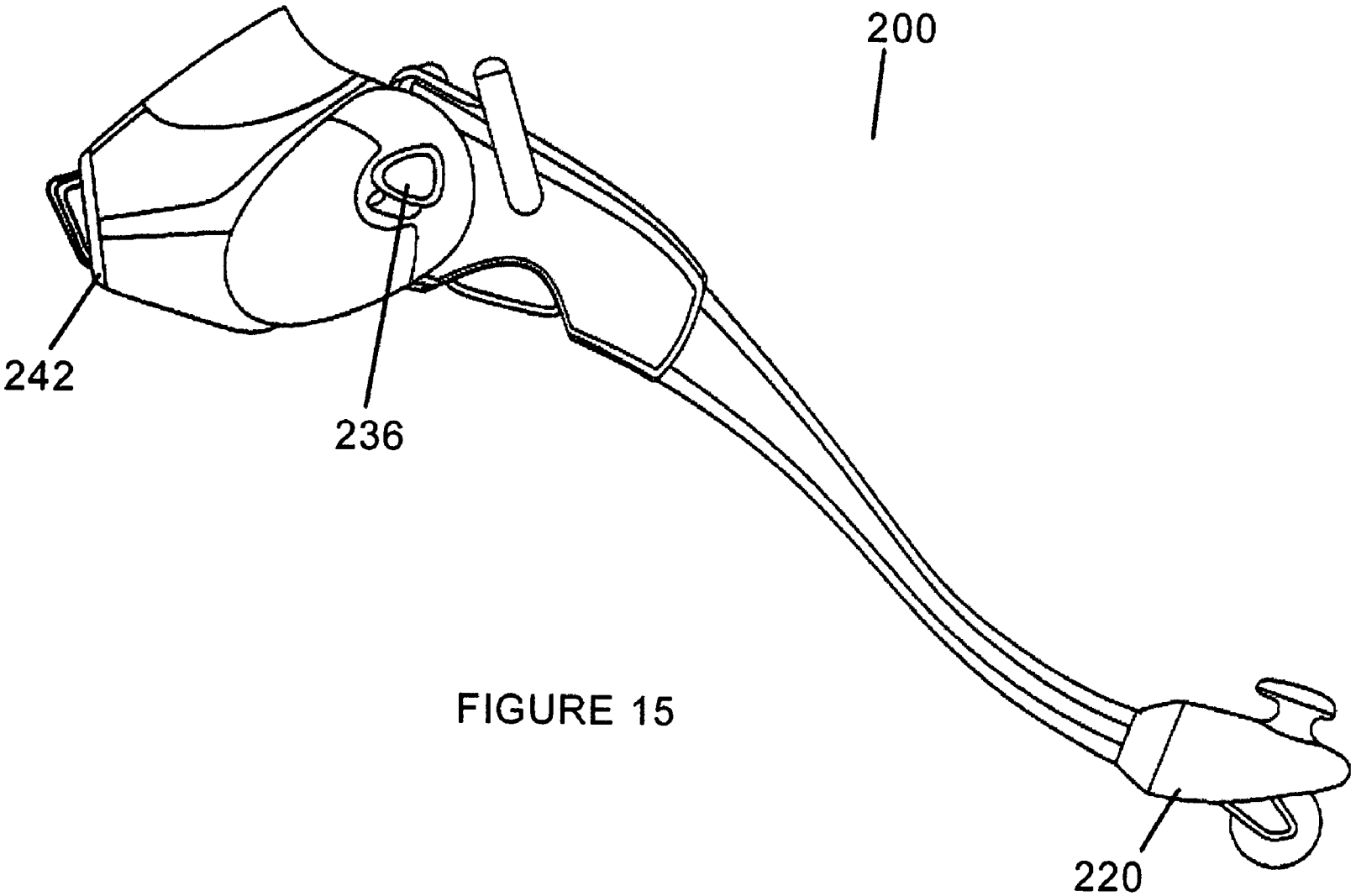
FIG. 15 is a left side view of the toy glider of FIG. 11.
Figure 16:
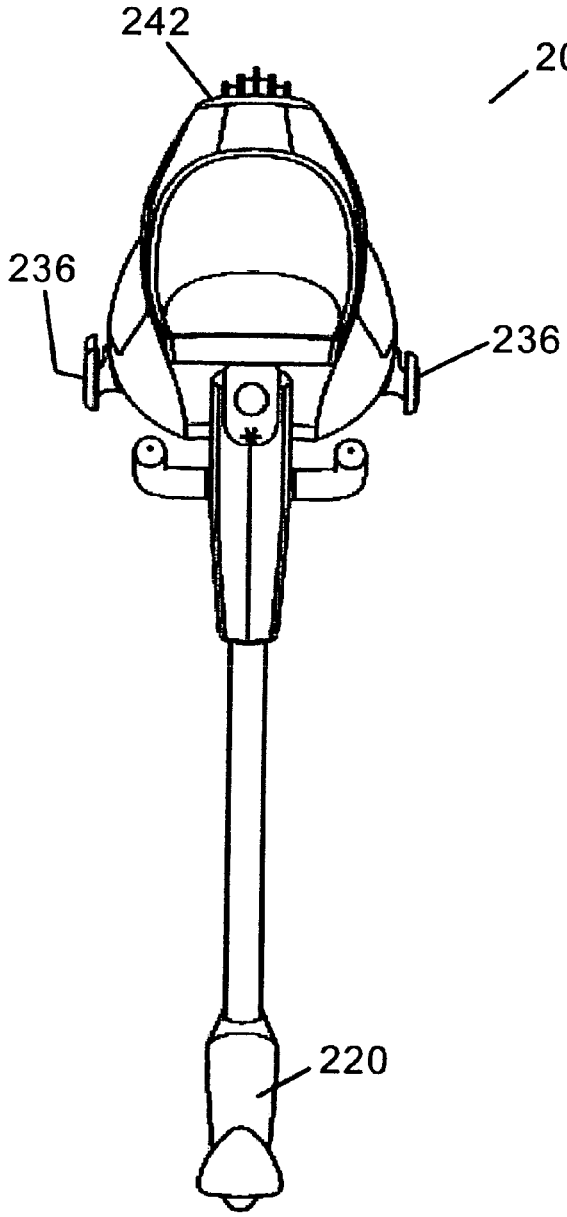
FIG. 16 is a top view of the toy glider of FIG. 11.
Figure 17:
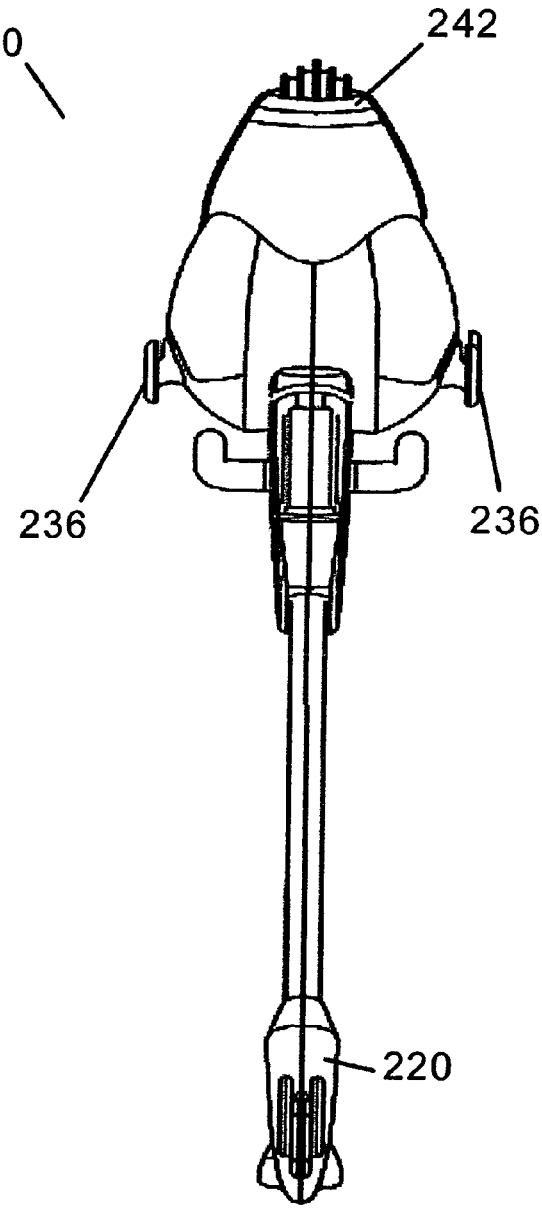
FIG. 17 is a bottom view of the toy glider of FIG. 11.
Figure 18:
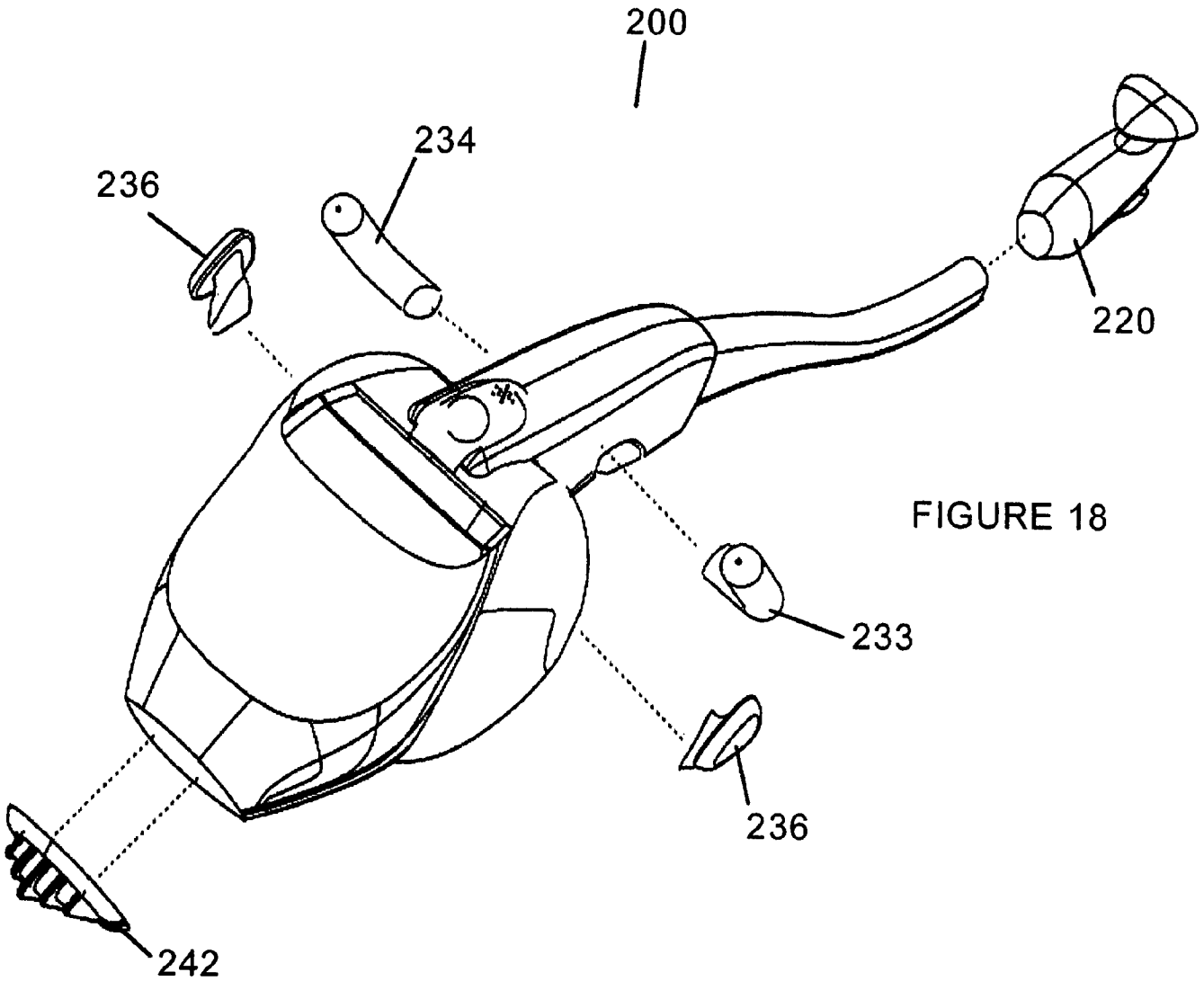
FIG. 18 is an exploded view of the toy glider of FIG. 11.
Figure 19:
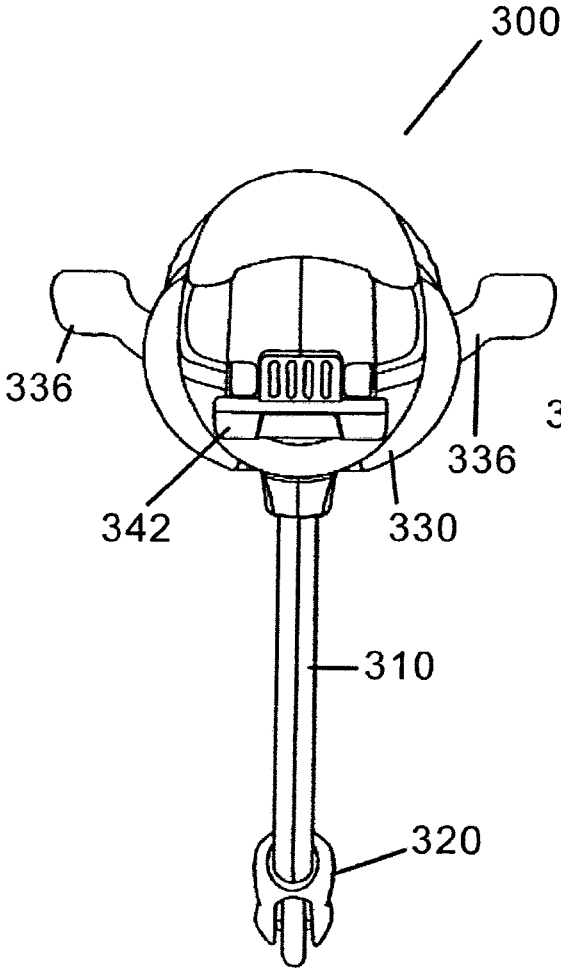
FIG. 19 is front view of a toy glider according to a third exemplary embodiment of the present invention.
Figure 20:
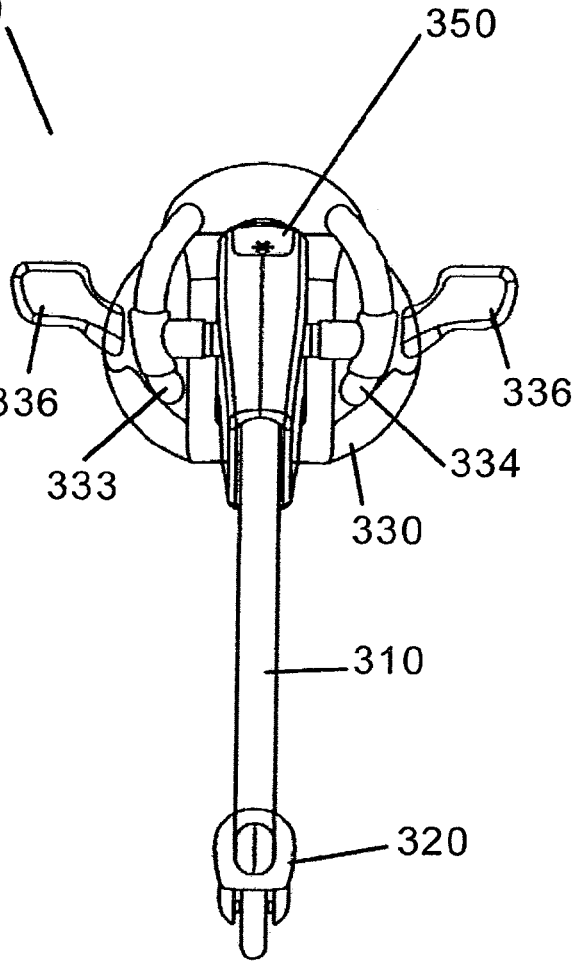
FIG. 20 is a rear view of a the toy glider of FIG. 19.
Figure 22:
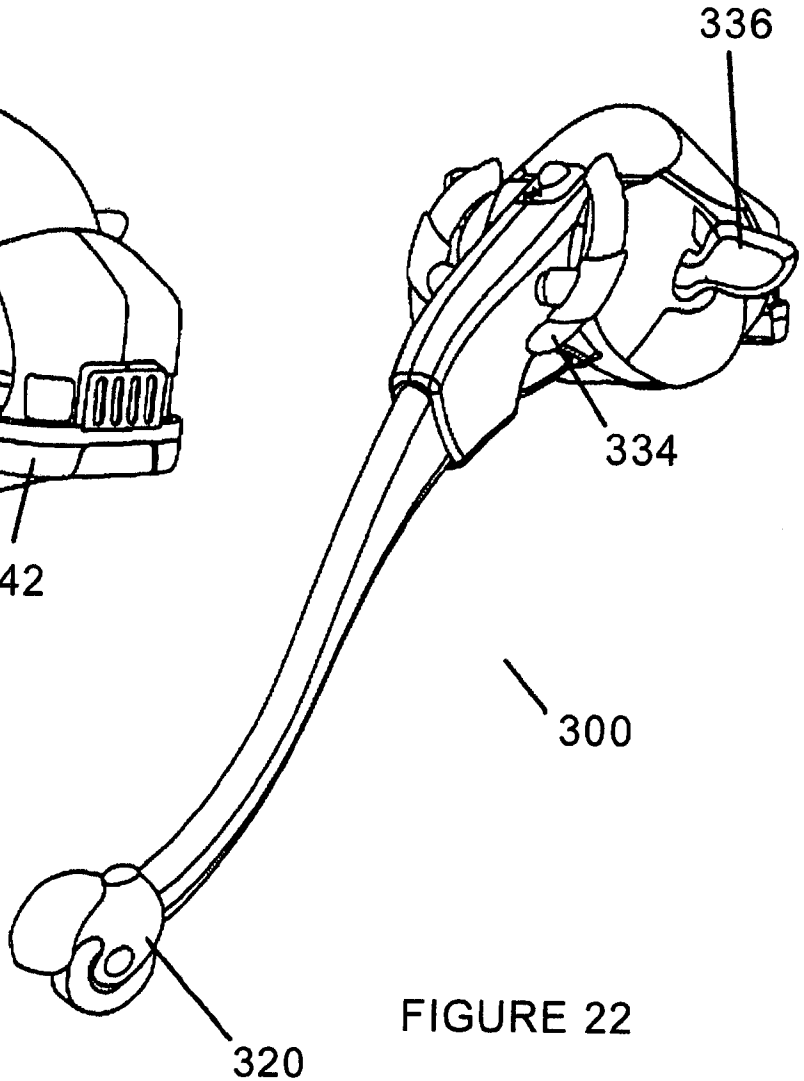
FIG. 22 is a rear perspective view of the toy glider of FIG. 19.
Figure 21:
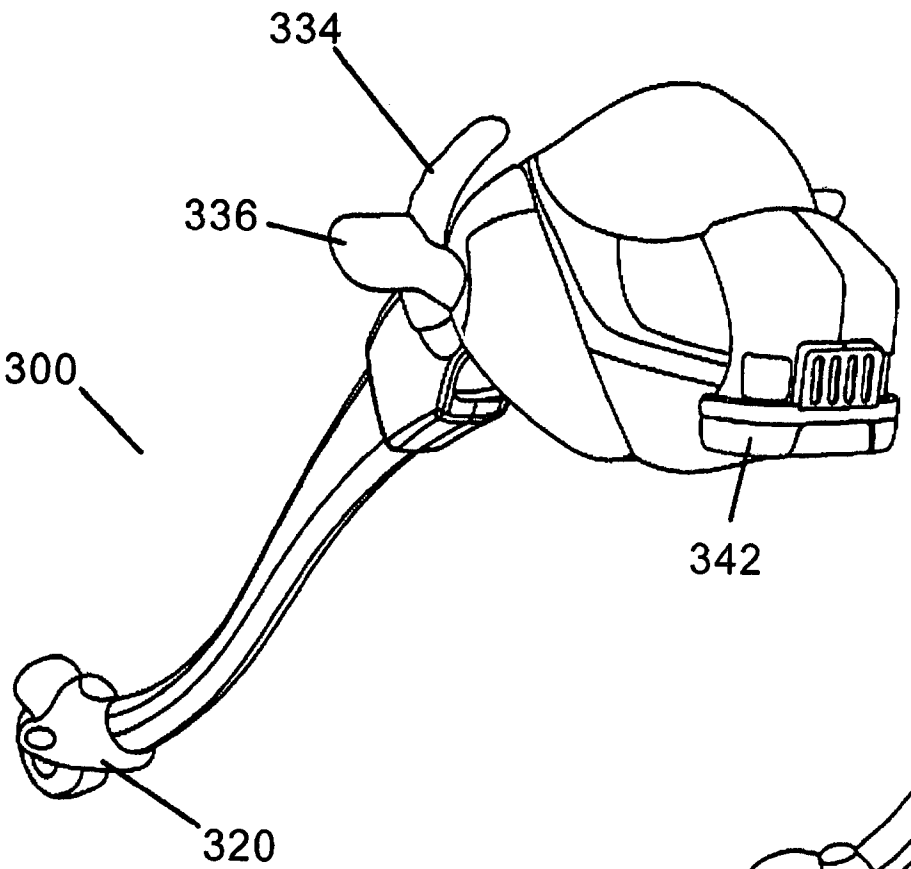
FIG. 21 is a front perspective view of the toy glider of FIG. 19.
Figure 23:
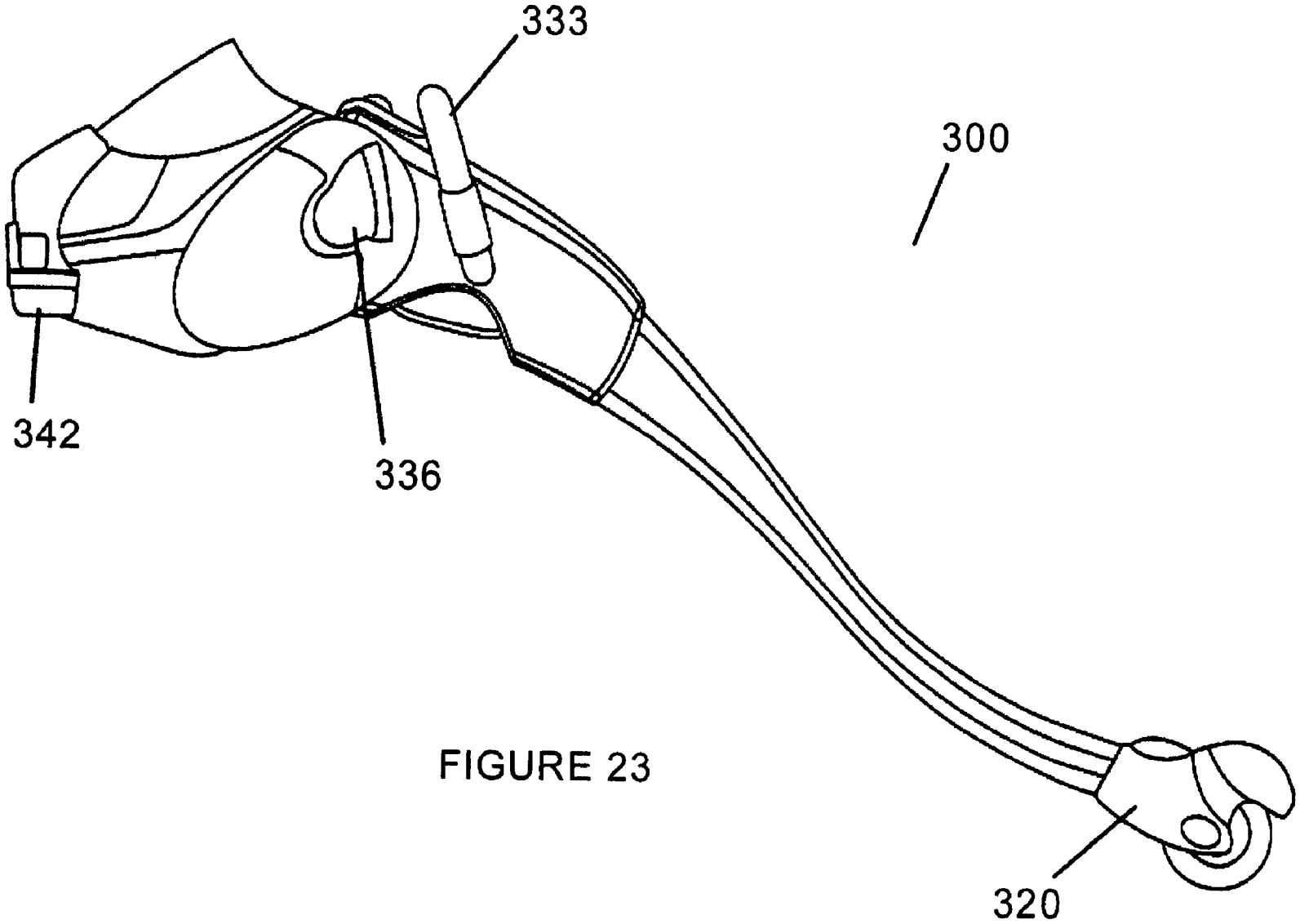
FIG. 23 is a left side view of the toy glider of FIG. 19.
Figure 24:
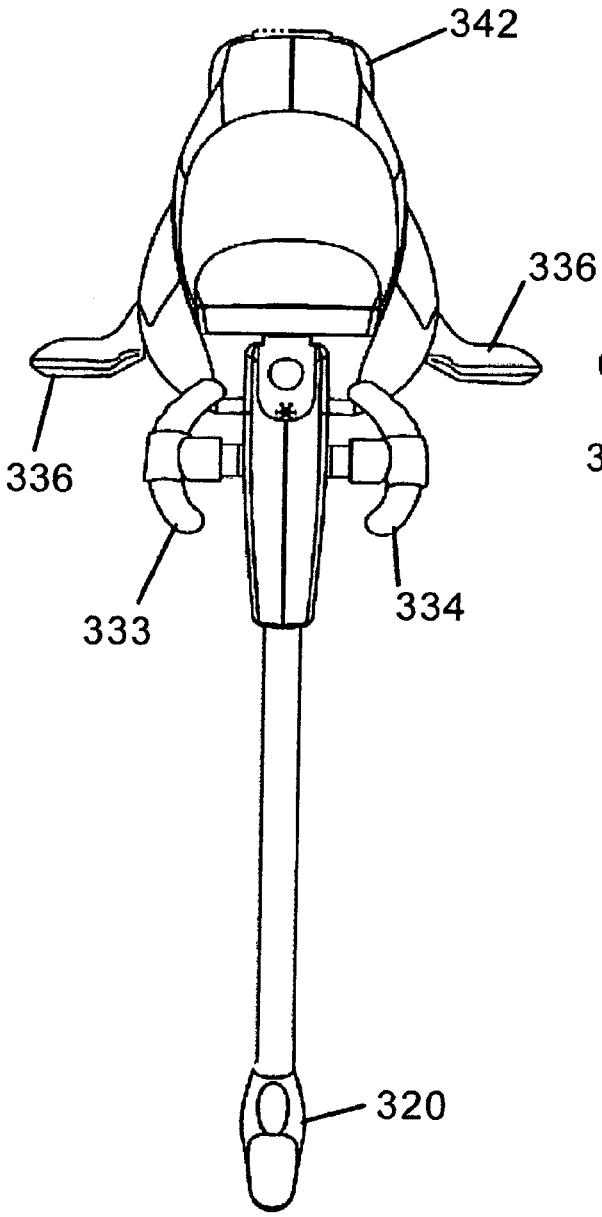
FIG. 24 is a top view of the toy glider of FIG. 19.
Figure 25:
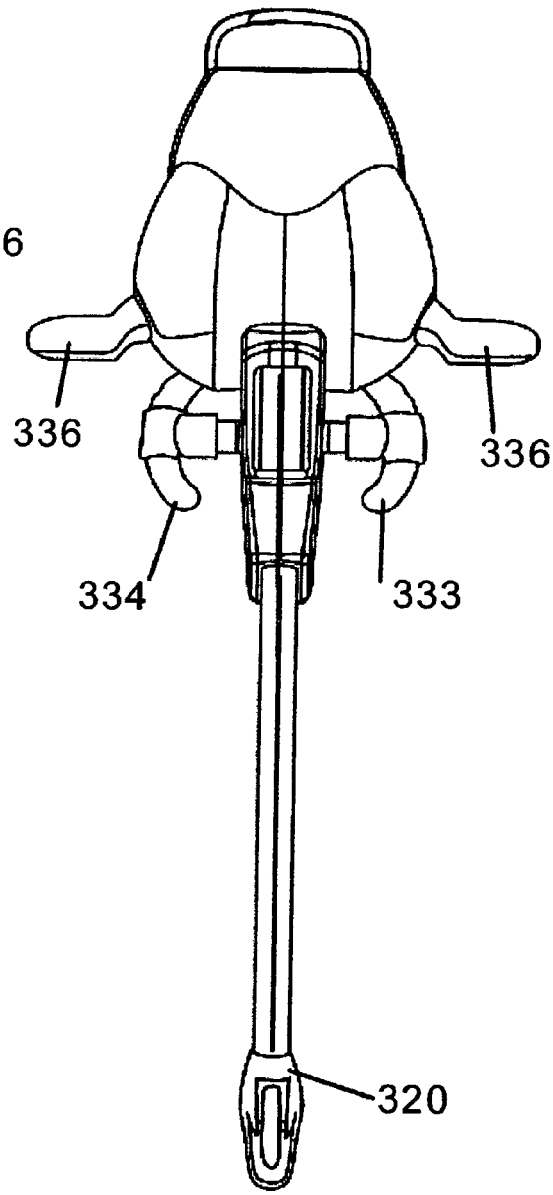
FIG. 25 is a bottom view of the toy glider of FIG. 19.
Figure 26:
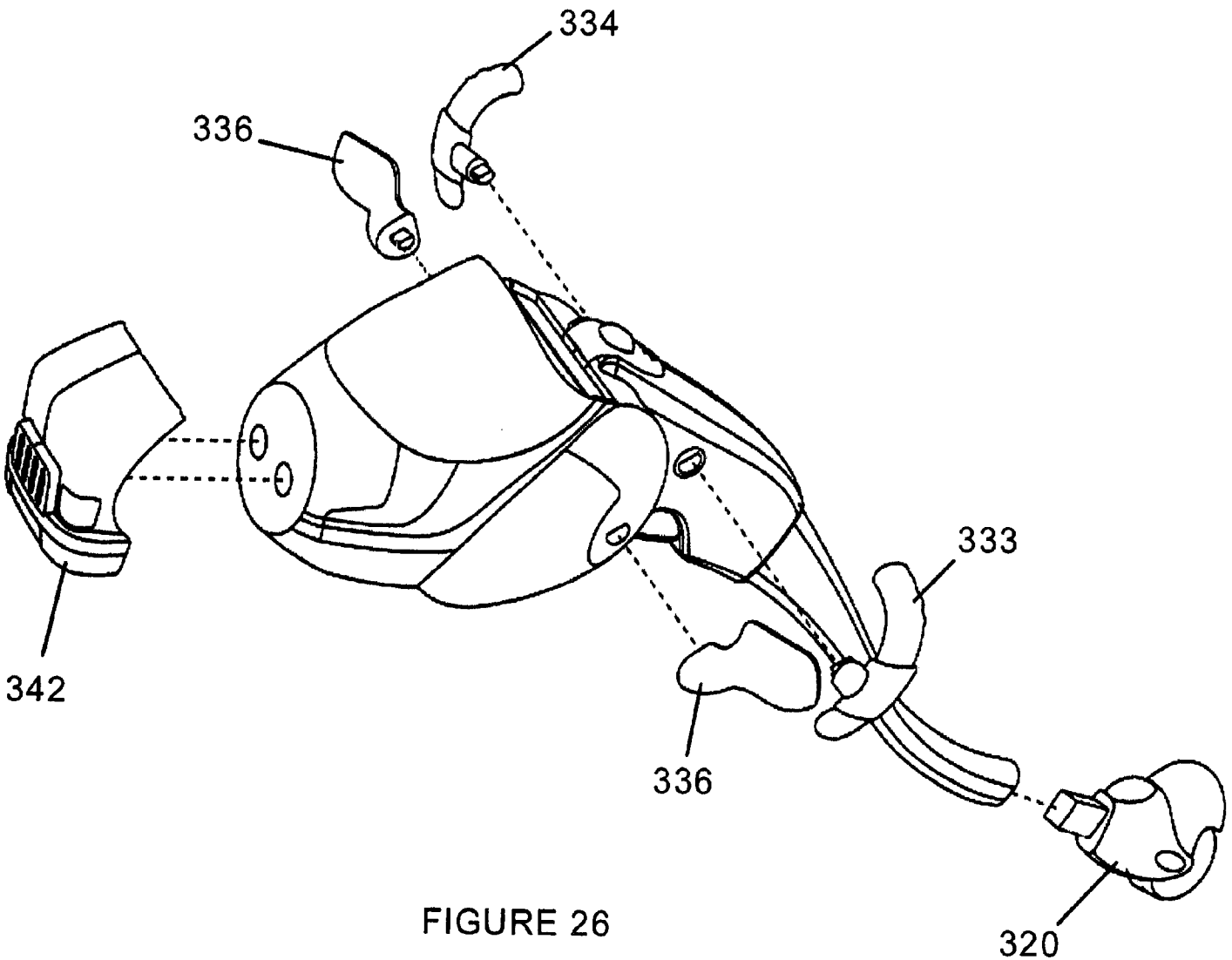
FIG. 26 is an exploded view of the toy glider of FIG. 19.
Figure 27:
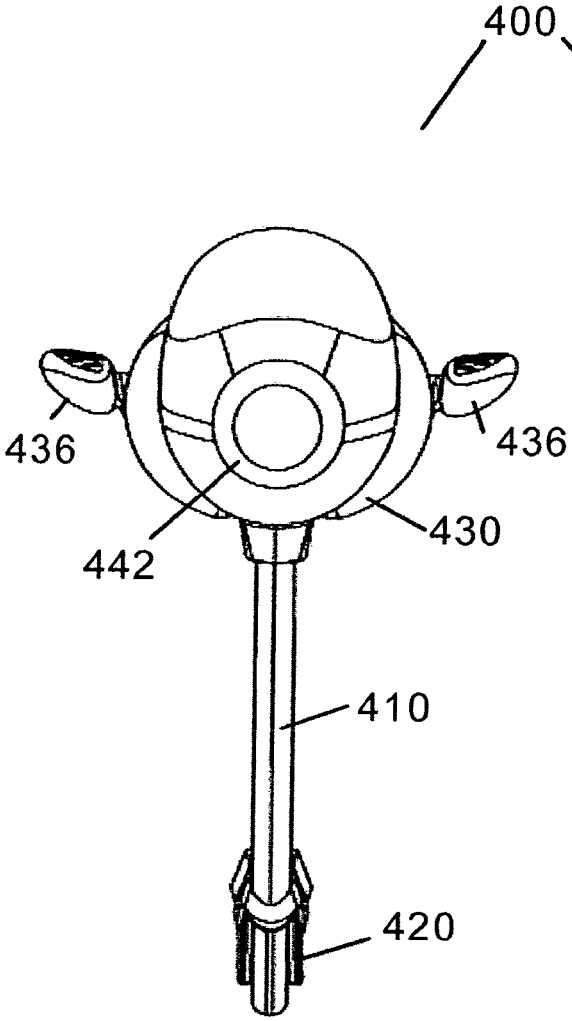
FIG. 27 is front view of a toy glider according to a fourth exemplary embodiment of the present invention.
Figure 28:
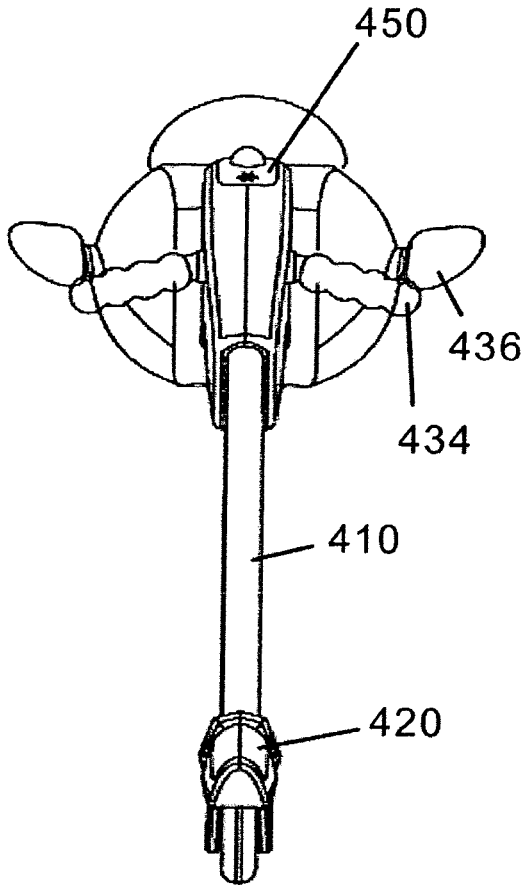
FIG. 28 is a rear view of a the toy glider of FIG. 27.
Figure 30:
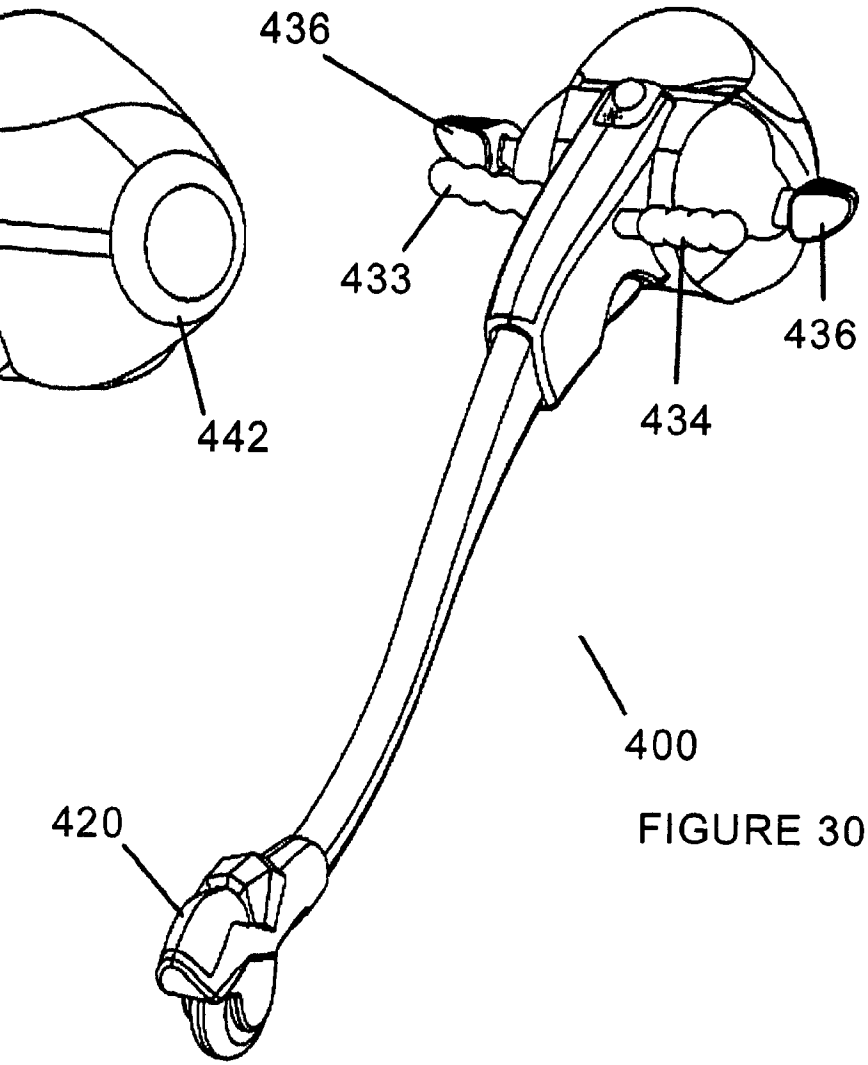
FIG. 30 is a rear perspective view of the toy glider of FIG. 27.
Figure 29:
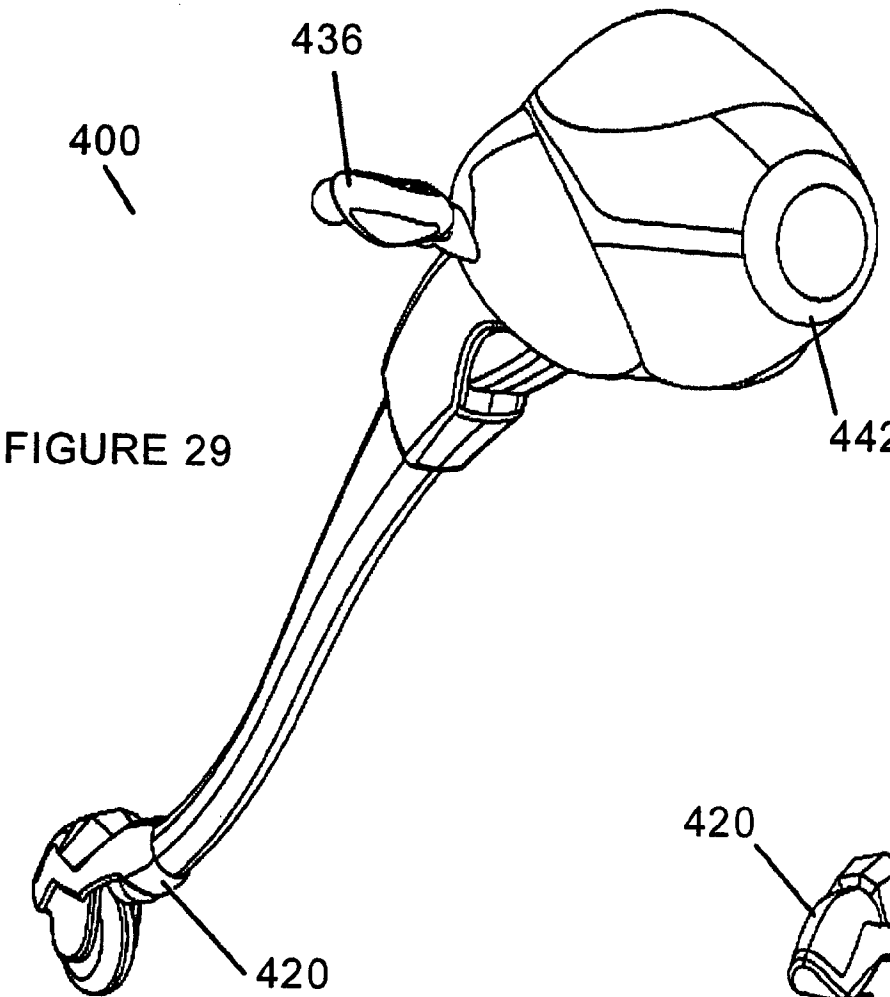
FIG. 29 is a front perspective view of the toy glider of FIG. 27.
Figure 32:
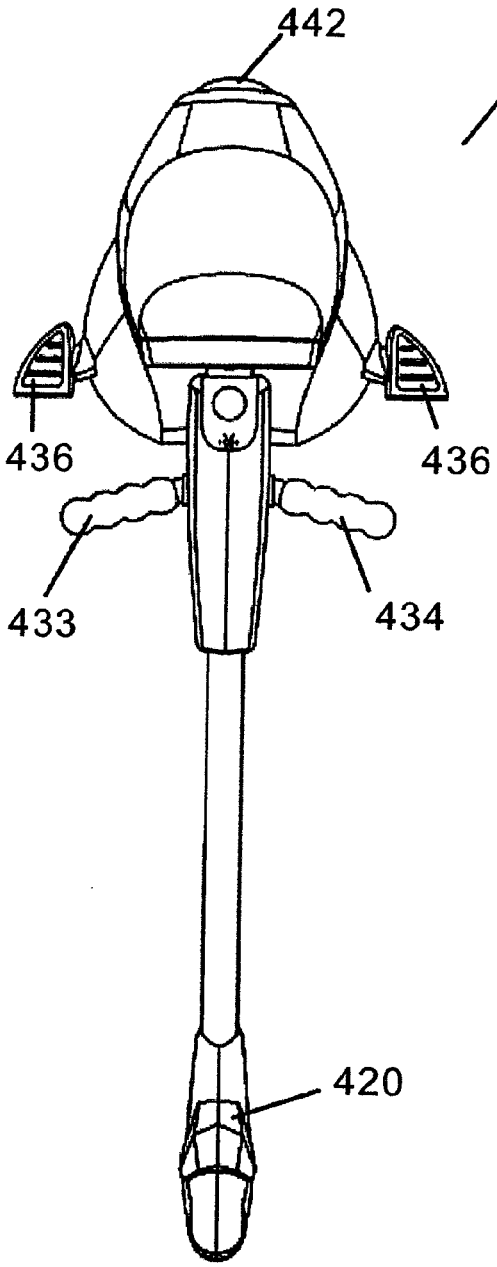
FIG. 32 is a top view of the toy glider of FIG. 27.
Figure 33:
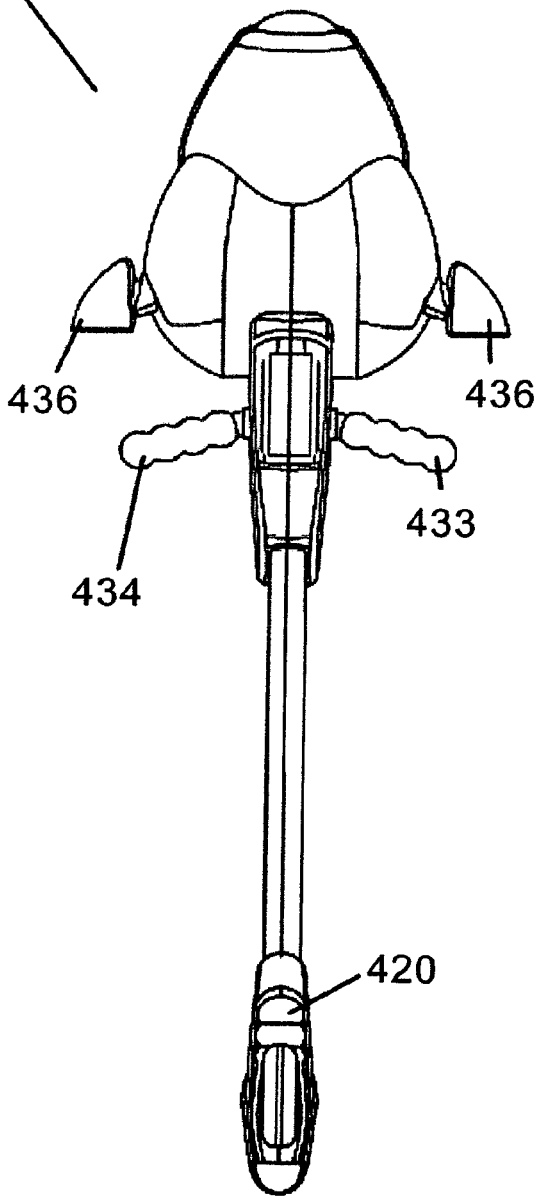
FIG. 33 is a bottom view of the toy glider of FIG. 27.
Figure 34:
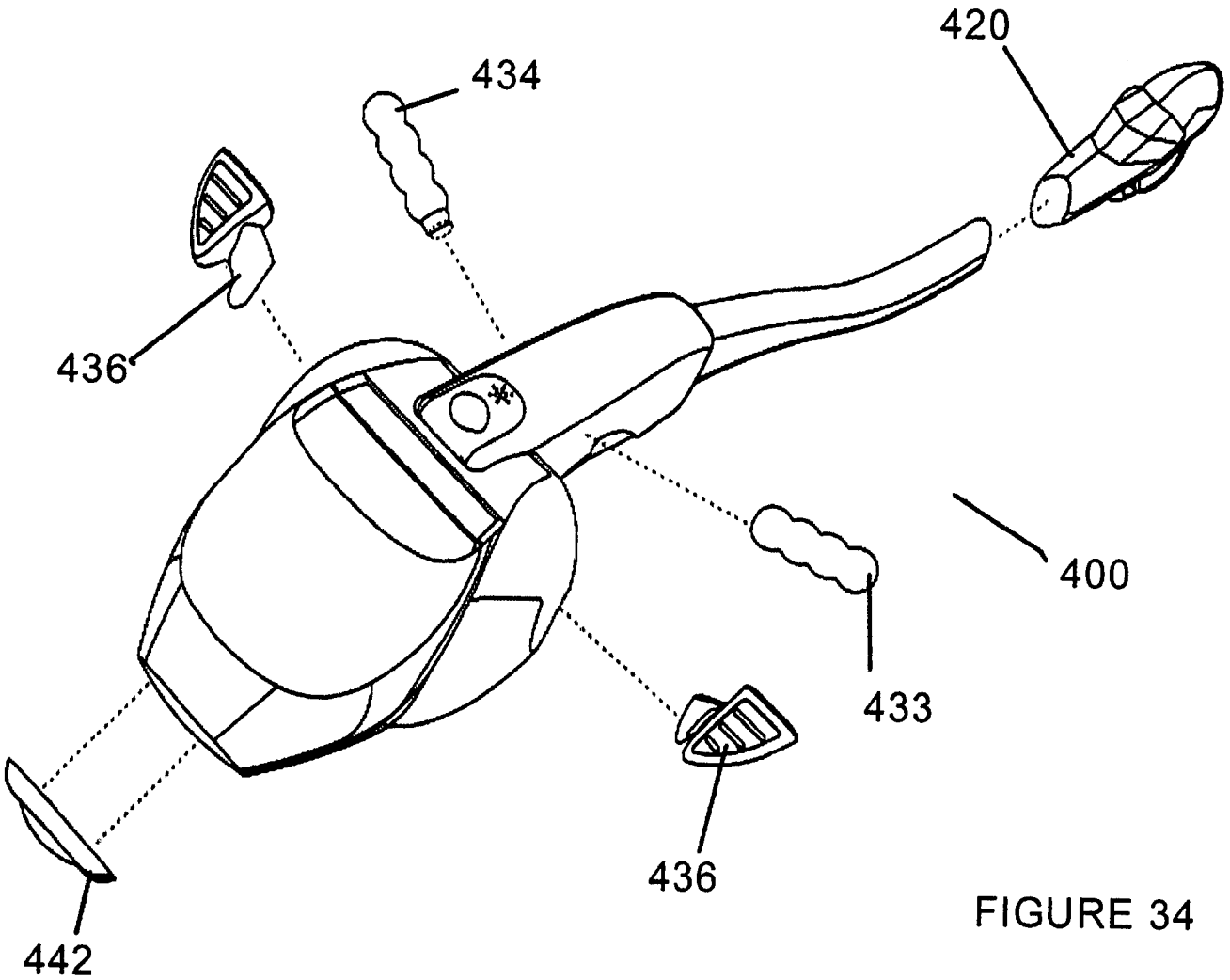
FIG. 34 is an exploded view of the toy glider of FIG. 27.
Figure 35:
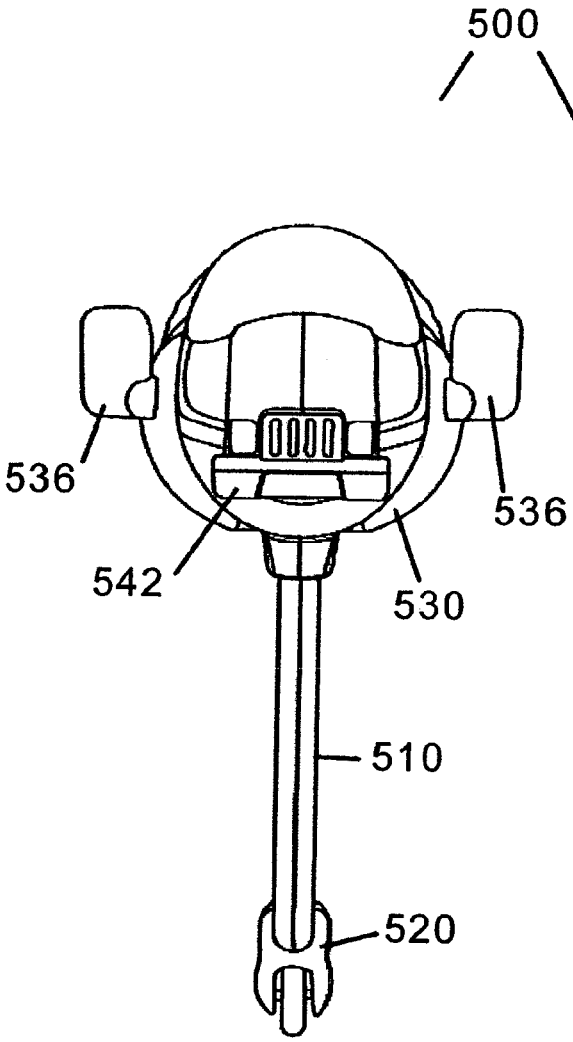
FIG. 35 is front view of a toy glider according to a fifth exemplary embodiment of the present invention.
Figure 36:
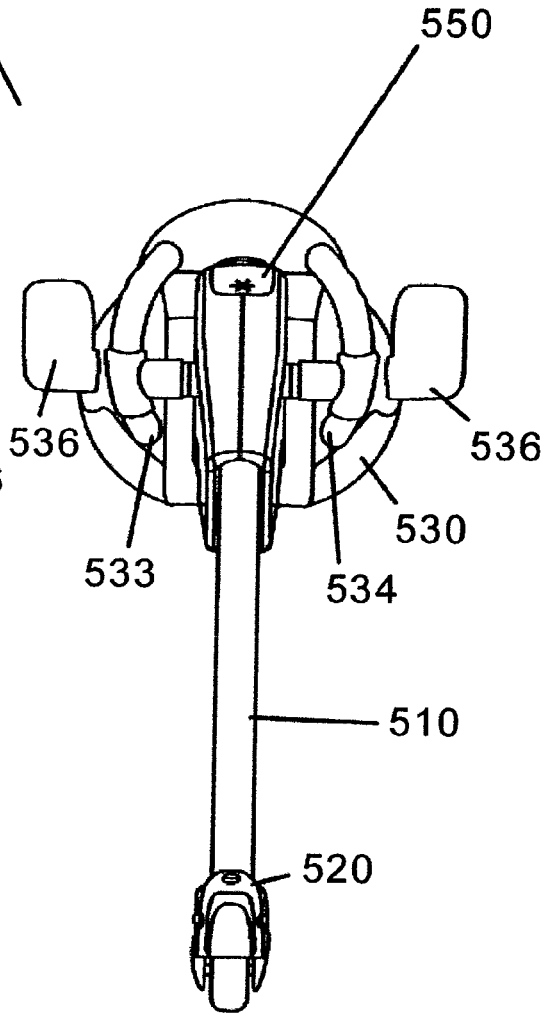
FIG. 36 is a rear view of a the toy glider of FIG. 35.
Figure 38:
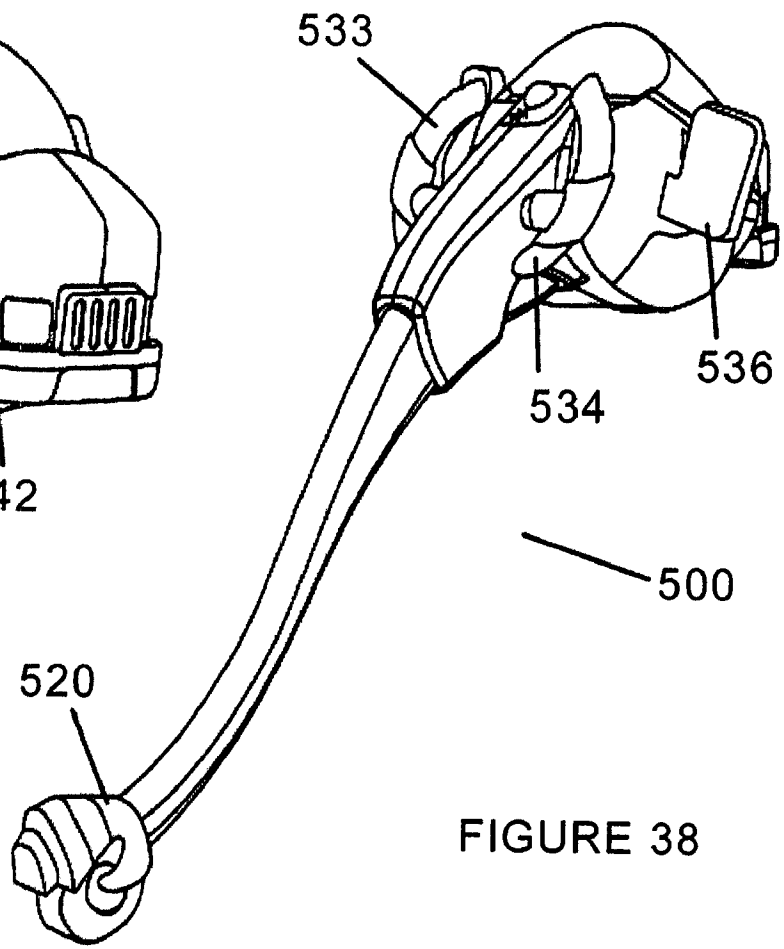
FIG. 38 is a rear perspective view of the toy glider of FIG. 35.
Figure 37:
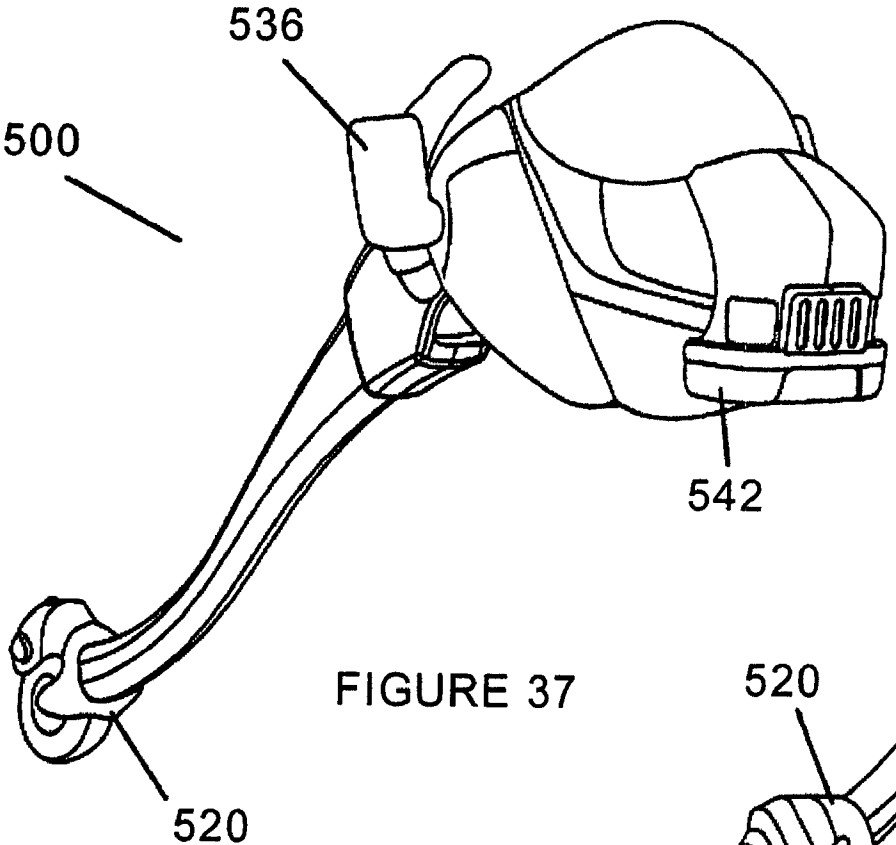
FIG. 37 is a front perspective view of the toy glider of FIG. 35.
Figure 39:
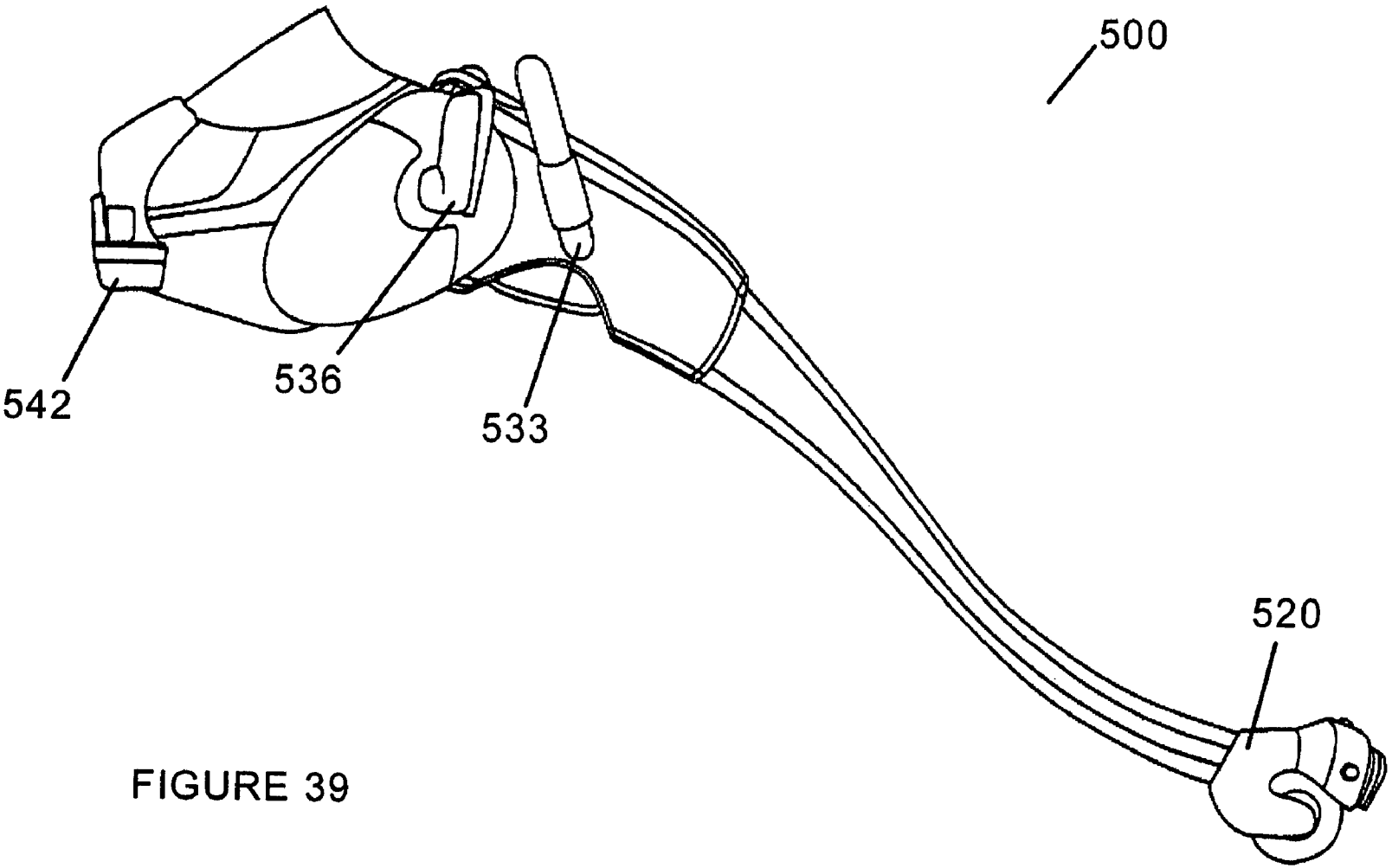
FIG. 39 is a left side view of the toy glider of FIG. 35.
Figure 40:
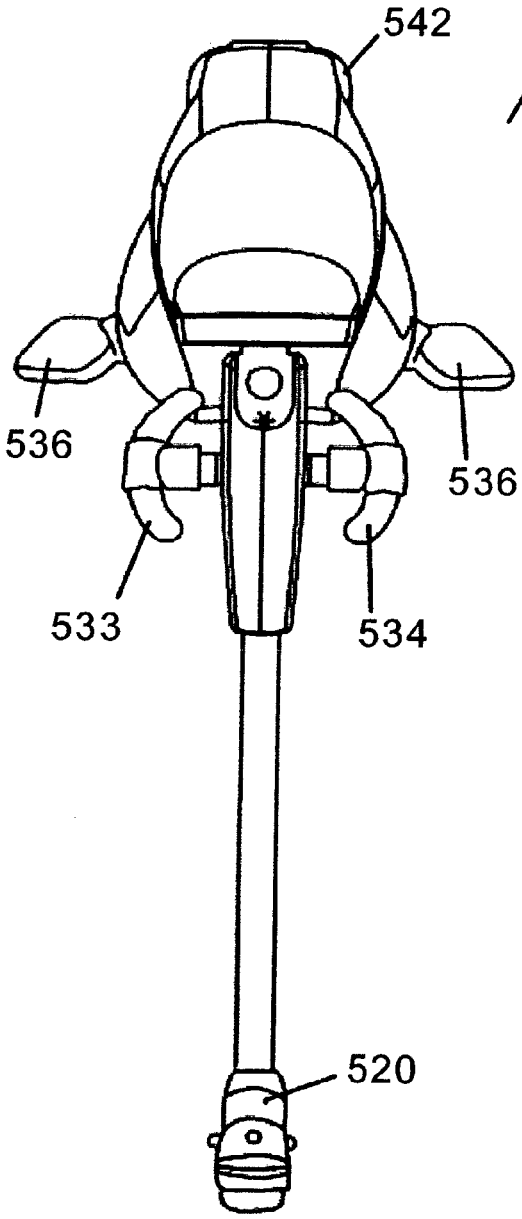
FIG. 40 is a top view of the toy glider of FIG. 35.
Figure 41:
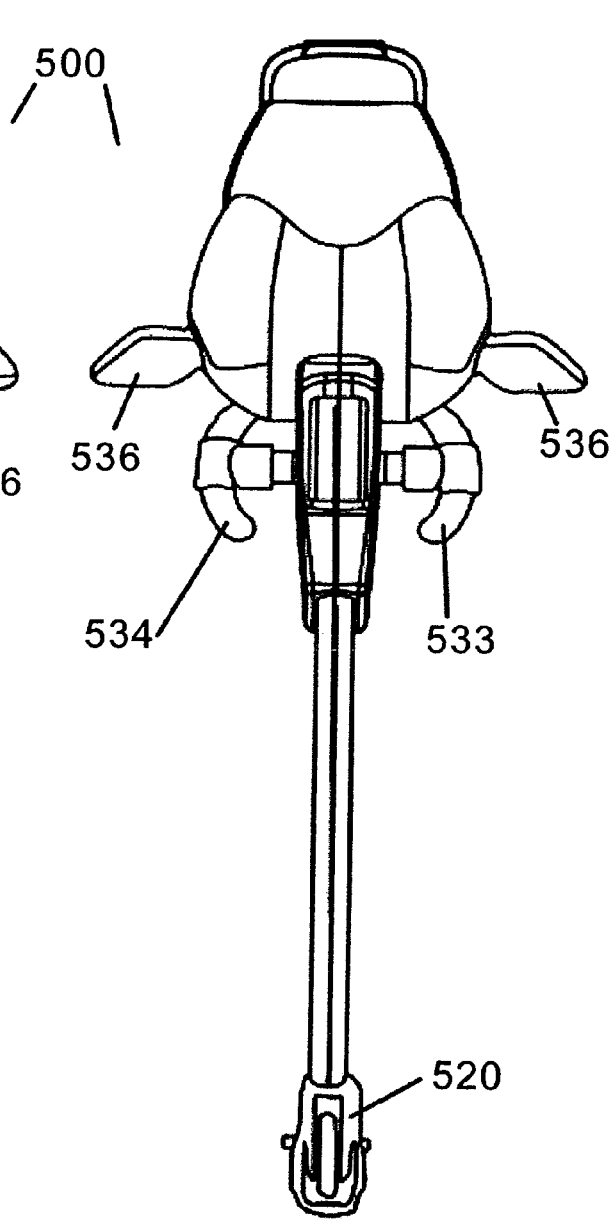
FIG. 41 is a bottom view of the toy glider of FIG. 35.
Figure 42:
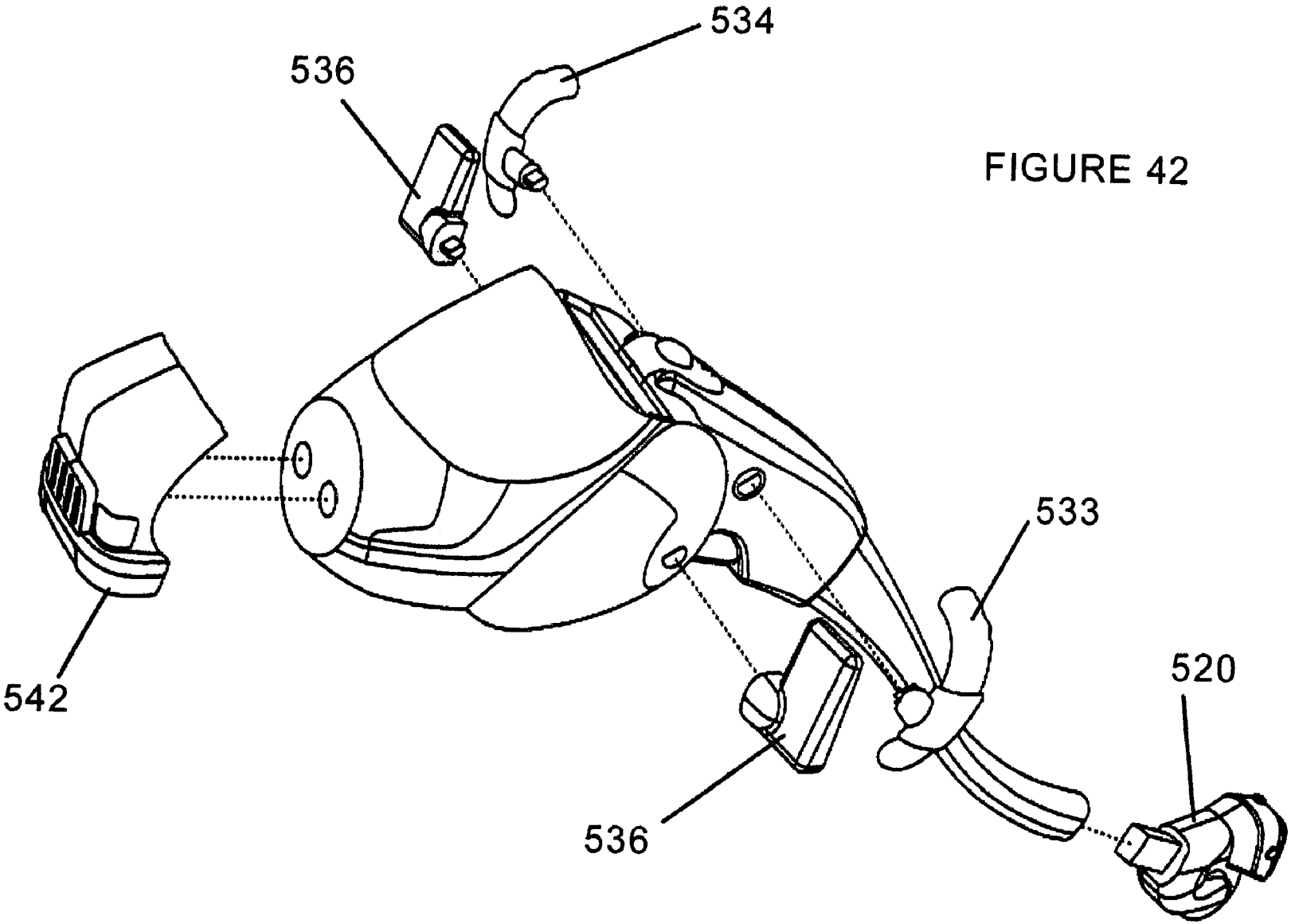
FIG. 42 is an exploded view of the toy glider of FIG. 35.
Figure 43:
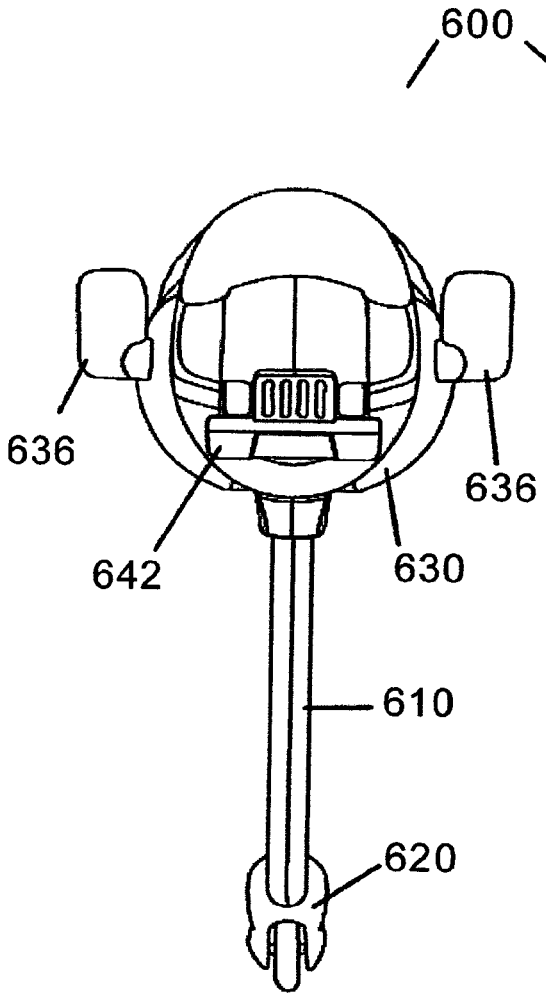
FIG. 43 is front view of a toy glider according to a sixth exemplary embodiment of the present invention.
Figure 44:
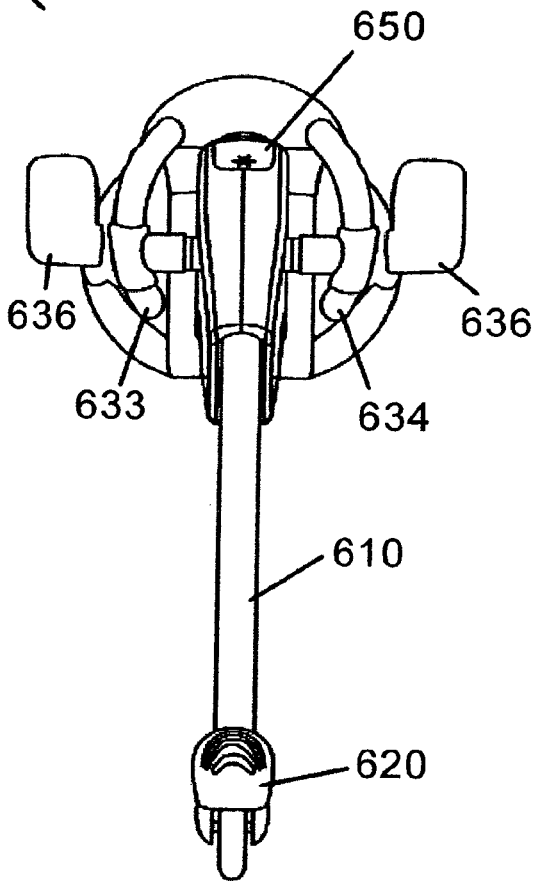
FIG. 44 is a rear view of a the toy glider of FIG. 43.
Figure 46:
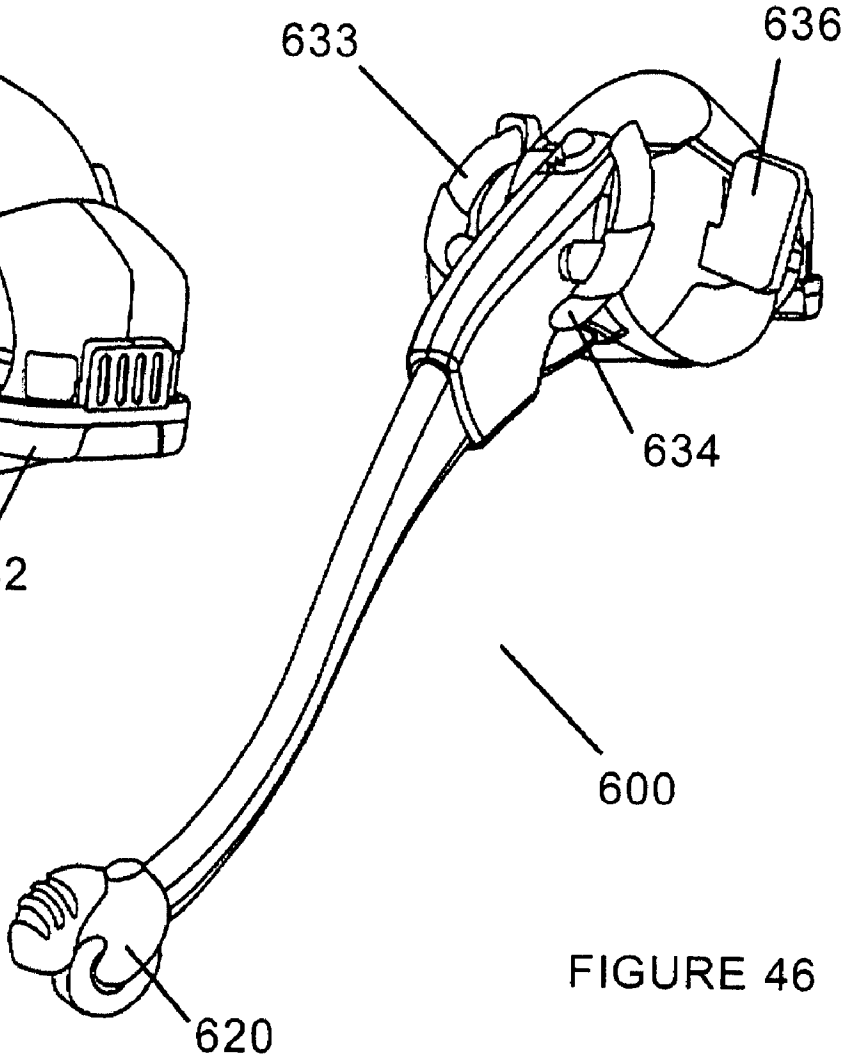
FIG. 46 is a rear perspective view of the toy glider of FIG. 43.
Figure 45:
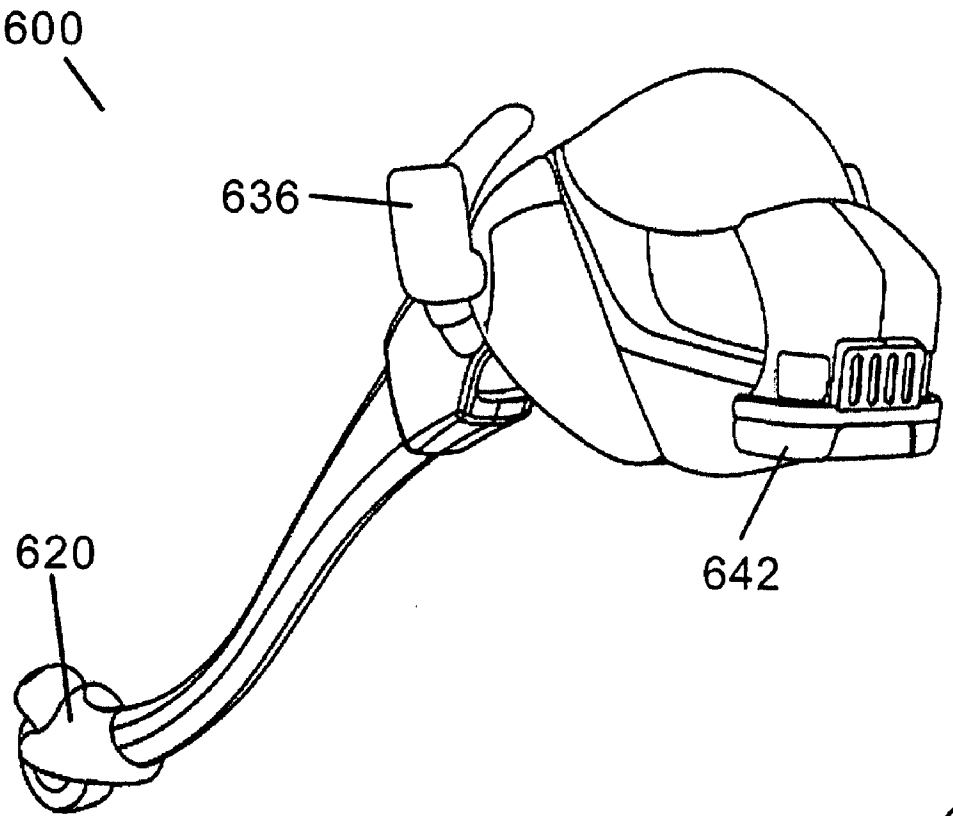
FIG. 45 is a front perspective view of the toy glider of FIG. 43.
Figure 47:
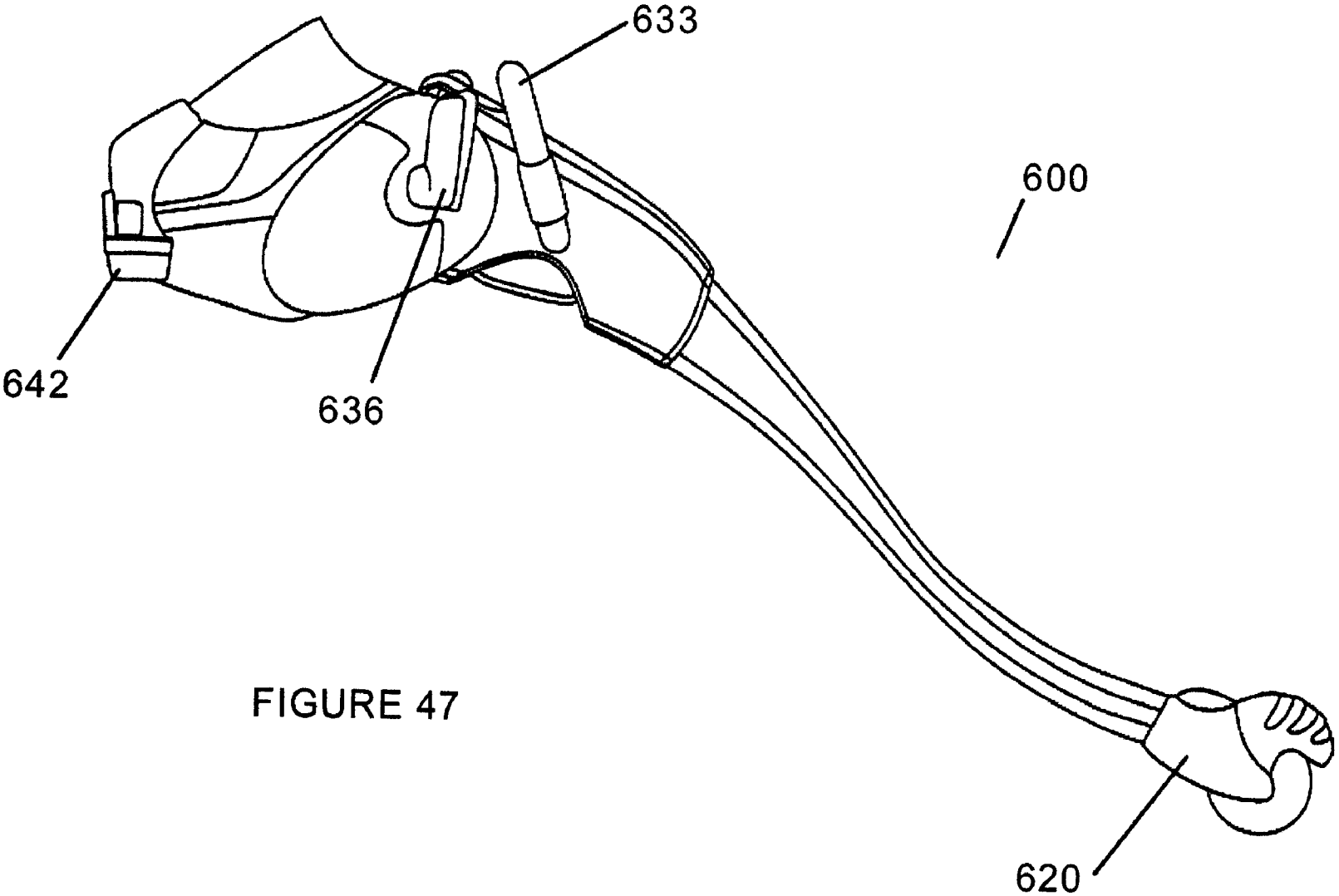
FIG. 47 is a left side view of the toy glider of FIG. 43.
Figure 48:
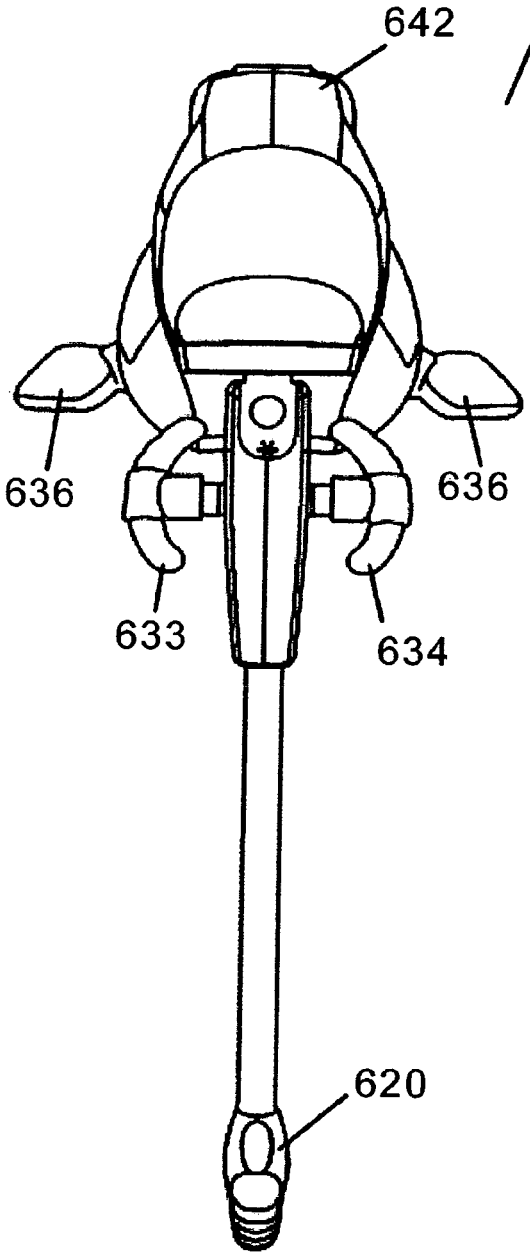
FIG. 48 is a top view of the toy glider of FIG. 43.
Figure 49:
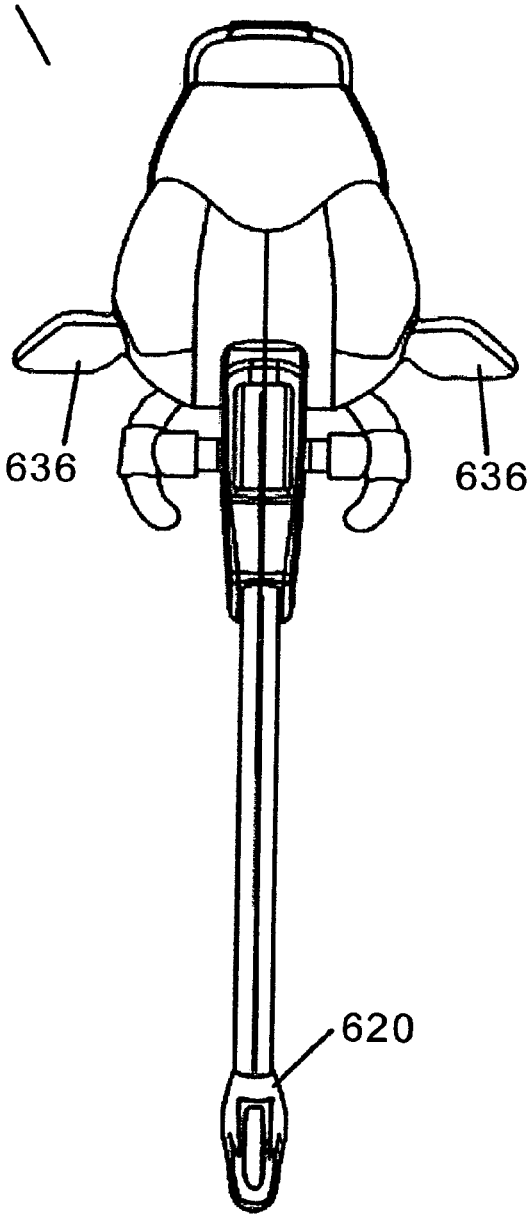
FIG. 49 is a bottom view of the toy glider of FIG. 43.
Figure 50:
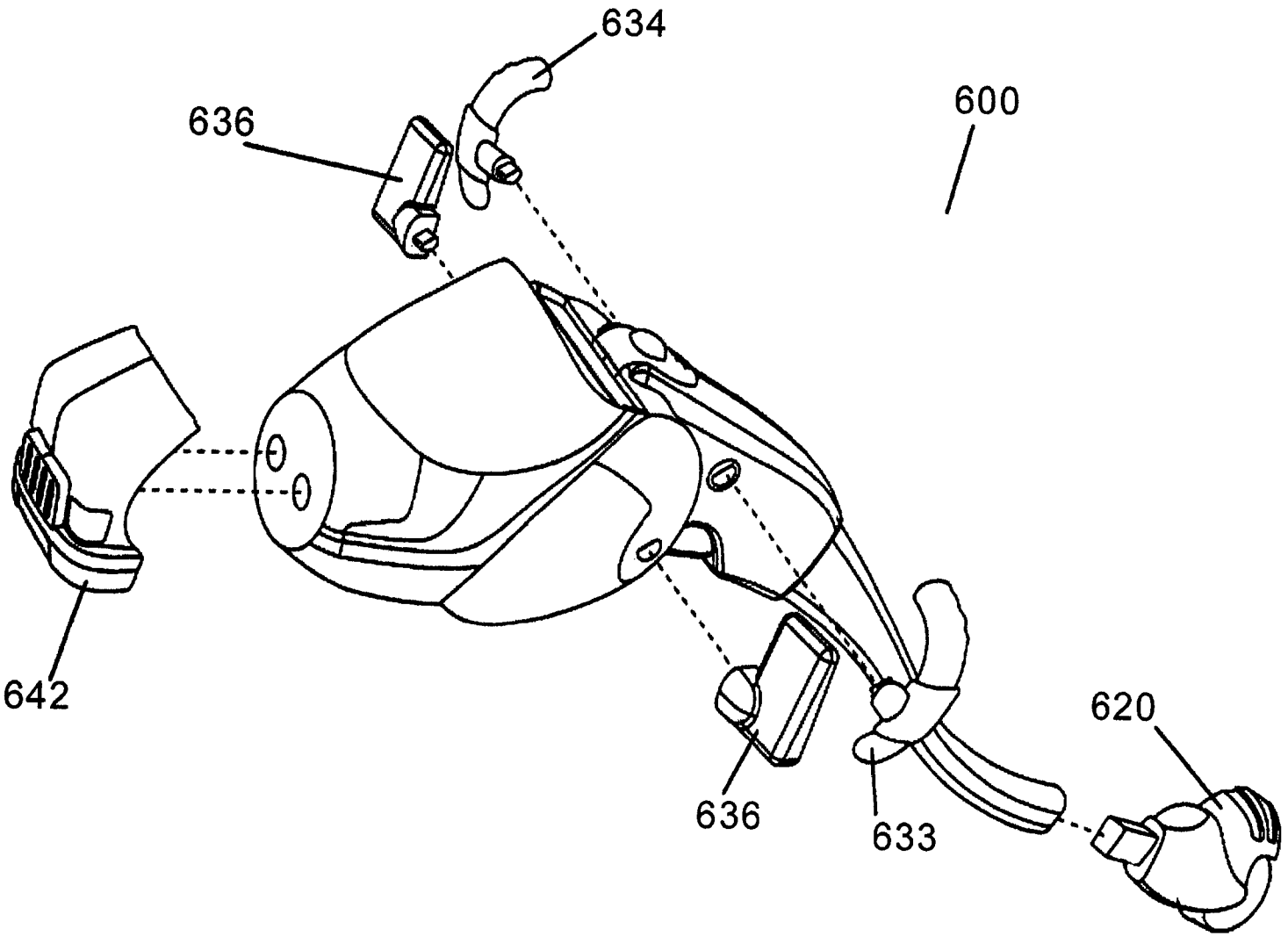
FIG. 50 is an exploded view of the toy glider of FIG. 43.

FIG. 10 is an exploded view of the toy glider 100 showing parts which are interchangeable. For example, although the toy glider 100 is described above as including a roller 120, decorative wings 136, and a decorative bumper 142, and alternate exemplary embodiment of the toy glider 100' may be manufactured which includes roller 120', decorative wings 136', and decorative bumper 142'. As will be noted, the roller 120, decorative wings 136, and a decorative bumper 142 of the toy glider 100 are made to respectively resemble the front end, side wings and rear wings of a jet plane, and the roller 120', decorative wings 136', and a decorative bumper 142' of the toy glider 100' are made to respectively resemble the front end, rear view mirrors and rear bumper of an automobile.

It will be noted by those of ordinary skill in the art that a plurality of different rollers (e.g., 120, 120'), wings (e.g., 136, 136') and bumpers (e.g., 142, 142') may be manufactured and provided to make the toy glider resemble different types of vehicles and/or objects (e.g., motorcycle, animal, cartoon character, etc.). The interchangeability of these parts permits the manufacturer of the toy glider to tailor the toy to different child's tastes with minimal effort and expense.

In operation, a child straddles the shaft 110 of the toy glider 100 and grasps the handles 133, 134. The child then moves the toy glider around using his or her feet while holding the handle 133, 134. The roller 120 is preferably disposed on the ground during operation, and the wheel 121 thereof rolls along the ground as the child moves the toy glider 100 about. As discussed above, the sound and/or light pad 150 may be activated during operation of the toy glider 100. This may be accomplished either by the actuation of a button, switch or other means by the child, automatically upon movement of the wheel 121, automatically upon grasping of the handles 133, 134, and/or by some other mechanism known to those of ordinary skill in the art.

FIGS. 11-18 show a toy glider 200 according to a second exemplary embodiment of the present invention. The toy glider 200 comprises a shaft 210, a roller 220, a housing 230, a front end 240 and a sound and/or light pad 250. The toy glider 200 is similar in appearance to the toy glider 100, and like reference numerals denote like elements. However, the roller 220, handles 233, 234, decorative wings 236 and decorative bumper 242 are made to resemble a spaceship.

FIGS. 19-26 show a toy glider 300 according to a third exemplary embodiment of the present invention. The toy glider 300 comprises a shaft 310, a roller 320, a housing 330, a front end 340 and a sound and/or light pad 350. The toy glider 300 is similar in appearance to the toy glider 100, and like reference numerals denote like elements. However, the roller 320, handles 333, 334, decorative wings 336 and decorative bumper 342 are made to resemble a police truck.

FIGS. 27-34 show a toy glider 400 according to a fourth exemplary embodiment of the present invention. The toy glider 400 comprises a shaft 410, a roller 420, a housing 430, a front end 440 and a sound and/or light pad 450. The toy glider 400 is similar in appearance to the toy glider 100, and like reference numerals denote like elements. However, the roller 420, handles 433, 434, decorative wings 436 and decorative bumper 442 are made to resemble a motorcycle.

FIGS. 35-42 show a toy glider 500 according to a fifth exemplary embodiment of the present invention. The toy glider 500 comprises a shaft 510, a roller 520, a housing 530, a front end 540 and a sound and/or light pad 550. The toy glider 500 is similar in appearance to the toy glider 100, and like reference numerals denote like elements. However, the roller 520, handles 533, 534, decorative wings 536 and decorative bumper 542 are made to resemble a fire truck.

FIGS. 43-50 show a toy glider 600 according to a sixth exemplary embodiment of the present invention. The toy glider 600 comprises a shaft 610, a roller 620, a housing 630, a front end 640 and a sound and/or light pad 650. The toy glider 600 is similar in appearance to the toy glider 100, and like reference numerals denote like elements. However, the roller 620, handles 633, 634, decorative wings 636 and decorative bumper 642 are made to resemble a delivery truck.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention.

What is claimed is:

1. A toy glider comprising:

a shaft;

an interchangeable decorative rear end member comprising: a housing which defines an opening at one end for receiving and attaching to a first end of the shaft; an extension protruding angularly from a rear portion of said housing, said extension comprising a pair of extension members for receiving an axel; and at least one wheel attached to the axel between said extension members;

an interchangeable decorative front end member comprising a housing for attaching to a second opposing end of the shaft, said front end member combining with the rear end member to give the toy glider the appearance of a particular mechanized vehicle; and a sound pad coupled to the housing, in use, the sound pad making sounds associated with the particular mechanized vehicle.

2. The toy glider of claim 1, wherein the shaft is contoured.

3. The toy glider of claim 1, further comprising a light pad coupled to the housing of the decorative front end member.

4. The toy glider of claim 1, wherein the decorative rear end member comprises at least two wheels attached to the axle between said extension members.

5. The toy glider of claim 1, further comprising at least one handle coupled to the housing of the decorative front end member for grasping the toy glider.

6. The toy glider of claim 1, wherein the decorative front end member is configured to resemble a front end of a jet, and wherein the decorative rear end member is configured to resemble a rear end of the jet.

7. The toy glider of claim 6, wherein the decorative front end member comprises at least one wing.

8. The toy glider of claim 7, wherein the decorative rear end member comprises at least one tail wing.

9. The toy glider of claim 1, wherein the decorative front end member is configured to resemble a front end of an automobile, and wherein the decorative rear end member is configured to resemble a rear end of the automobile.

10. The toy glider of claim 1, wherein the housing of said decorative rear end member defines a dowel protruding upwardly towards the shaft for attaching said decorative rear member to the shaft, and wherein the shaft defines an opening at its first end for receiving the dowel.

11. The toy glider of claim 1, further comprising a plurality of decorative front end pieces and a plurality of rear end pieces, said front end and rear end pieces adapted for attaching to said decorative front end and rear end members, respectively, for providing additional decorative accents to the toy glider.

12. A method for manufacturing a toy glider comprising the steps of:

providing a shaft;

providing a plurality of different interchangeable decorative rear end members, each of said rear end members resembling a different type of vehicle or object, and each rear end member comprising: a housing which defines an opening at one end for receiving and attaching to a first end of the shaft; an extension protruding angularly from a rear portion of said housing, said extension comprising a pair of extension members for receiving an axel; and at least one wheel attached to the axel between said extension members;

providing a plurality of different interchangeable decorative front end members, each of said front end members configured to combine with a corresponding one of the rear end members to give the toy glider an appearance of a particular vehicle or object, and each of said front end members comprising a housing for receiving and attaching to a second opposing end of the shaft;

coupling at least one of said decorative rear end members to a first end of the shaft; and, coupling a corresponding one of said decorative front end members to a second opposing end of the shaft.

13. The method of claim 12, wherein the decorative front and rear end members that are coupled to the shaft combine to give the toy glider an appearance of an aircraft.

14. The method of claim 13, further comprising the steps of:

providing a plurality of different interchangeable wings, the wings being adapted to make the toy glider resemble different types of aircrafts; and coupling at least one wing to the decorative front end member and at least one wing to the decorative rear end member.

15. The method of claim 12, further comprising the steps of:

providing a plurality of different interchangeable bumpers, each of said bumpers being adapted to make the toy glider resemble different types of automobiles; and coupling at least one bumper to the housing of the decorative front end member and at least one corresponding bumper to the decorative rear end member, thereby making the toy glider resemble a particular automobile.

16. The method of claim 12, further comprising:

providing a plurality of decorative front end pieces and a plurality of rear end pieces, said front end and rear end pieces adapted for attaching to said decorative front end and rear end members, respectively, for providing additional decorative accents to the toy glider; and attaching at least one decorative front end piece to said decorative front end member and attaching at least one decorative rear end piece to said decorative rear end member.

17. The method of claim 12, wherein the housing of said decorative rear end member defines a dowel protruding upwardly towards the shaft for attaching said decorative rear member to the shaft, and wherein the shaft defines an opening at its first end for receiving the dowel.

* * * * *